US007340197B2

(12) United States Patent
Murayama et al.

(10) Patent No.: US 7,340,197 B2
(45) **Date of Patent: *Mar. 4, 2008**

(54) PROCESS CARTRIDGE, MOUNTING MECHANISM THEREFOR AND ELECTROPHOTOGRAPHIC IMAGE FORMING APPARATUS

(75) Inventors: Kazunari Murayama, Suntoh-gun (JP); Kanji Yokomori, Odawara (JP); Susumu Nittani, Suntoh-gun (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

This patent is subject to a terminal disclaimer.

(21) Appl. No.: 11/190,022

(22) Filed: Jul. 27, 2005

(65) Prior Publication Data

US 2005/0260011 A1 Nov. 24, 2005

Related U.S. Application Data

(62) Division of application No. 10/746,035, filed on Dec. 29, 2003, now Pat. No. 6,980,758.

(30) Foreign Application Priority Data

Aug. 29, 2003 (JP) ..... 2003-209842

(51) Int. Cl.
*G03G 21/16* (2006.01)

(52) U.S. Cl. ..... 399/111; 399/117

(58) Field of Classification Search ..... 399/107, 399/110, 111, 112, 116, 117
See application file for complete search history.

(56) References Cited

U.S. PATENT DOCUMENTS 6,690,902 B2 2/2004 Noda et al. ..... 399/111
6,714,750 B2 3/2004 Tenada et al. ..... 399/111

(Continued)

FOREIGN PATENT DOCUMENTS

CN 1354399 6/2002

(Continued)

OTHER PUBLICATIONS

Translation of Chinese Office Action in Appln. No. 200310123801.9 issued Feb. 9, 2007.

(Continued)

*Primary Examiner*—Hoan Tran
(74) *Attorney, Agent, or Firm*—Fitzpatrick, Cella, Harper & Scinto

(57) ABSTRACT

A process cartridge which is capable of being carried on a movable guide provided in the main assembly of an electrophotographic image forming apparatus and which is movable from a receiving position toward a mount position in interrelation with movement of the movable guide, includes an electrophotographic photosensitive drum; process means actable on the drum; a cartridge frame supporting the drum and the process means; a first portion to be carried, provided at one longitudinal end of the drum, for being supported by the movable guide; a second portion to be carried, provided at the other longitudinal end of the drum, for being supported by the movable guide; a first positioning portion to be positioned relative to a main assembly, the first positioning portion extending outwardly from the cartridge frame adjacent the other longitudinal end of the drum; a second positioning portion to be positioned relative to the main assembly, the second positioning portion extending outwardly from the cartridge frame adjacent the other longitudinal end of the drum; and an engaging portion for engagement with a locking portion which is movable in interrelation with the movement of the movable guide to receive a pulling force for movement from the receiving position toward the mount position.

16 Claims, 16 Drawing Sheets

U.S. PATENT DOCUMENTS

| | | | | |
|---|---|---|---|---|
| 6,735,406 | B1 | 5/2004 | Noda | 399/111 |
| 6,792,229 | B2 | 9/2004 | Matsuzaki | 399/111 |
| 6,934,489 | B2 | 8/2005 | Yokomori et al. | 399/111 |
| 7,039,339 | B2 | 5/2006 | Yokomori et al. | 399/111 |
| 7,184,686 | B2 * | 2/2007 | Kanno et al. | 399/111 |
| 2002/0159790 | A1 | 10/2002 | Noda et al. | 399/111 |

FOREIGN PATENT DOCUMENTS

| | | |
|---|---|---|
| CN | 1431565 | 7/2003 |
| EP | 1 091 266 | 4/2001 |
| EP | 1 207 437 | 5/2002 |
| EP | 1 207 437 A2 | 5/2002 |
| EP | 1 241 536 | 9/2002 |
| EP | 1 336 905 | 8/2003 |
| JP | 2-159790 | 6/1990 |
| JP | 2001-175147 | 6/2001 |
| JP | 2001-249601 | 9/2001 |
| JP | 2002-156889 | 5/2002 |
| JP | 2003-208074 | 7/2003 |

OTHER PUBLICATIONS

Translation of final Russian Office Action in Appln. No. 2004126181/28(028310).

* cited by examiner

PROCESS CARTRIDGE, MOUNTING MECHANISM THEREFOR AND ELECTROPHOTOGRAPHIC IMAGE FORMING APPARATUS

CROSS REFERENCE TO RELATED APPLICATION

This application is a divisional of U.S. application Ser. No. 10/746,035, filed Dec. 29, 2003.

BACKGROUND OF THE INVENTION

Field of the Invention

The present invention relates to a process cartridge, a mechanism for mounting a process cartridge, and an electrophotographic image forming apparatus, Here, an electrophotographic image forming apparatus refers to an apparatus which forms an image all recording medium (for example, recording paper, OHP sheet. fabric, etc.) with the use of one of the electrophotographic image forming methods. As examples of an electrophotographic image forming apparatus, there are an electrophotographic copying machine, an electrophotographic printer (for example, laser printer, LED printer, etc.) a facsimile machine, a word processor, as well as a complex machine (multi-function printer, etc.) comprising a combination of two or more of the preceding apparatuses.

A process cartridge refers to a cartridge which is removably mountable in the main assembly of an image forming apparatus, and in which a charging means as a processing means, a developing means or a cleaning means as a processing means, and an electrophotographic photosensitive member, are integrally disposed. It also refers to a cartridge which is removably mountable in the main assembly of an image forming apparatus, and in which an electrophotographic photosensitive member and a minimum of one processing means among a charging means, a developing means, and cleaning means are integrally disposed. It also refers to a cartridge which is removably mountable in the main assembly of an electrophotographic image forming apparatus, and in which an electrophotographic photosensitive member and a minimum of one processing means, specifically, a developing apparatus, are integrally disposed.

In the field of an electrophotographic image forming apparatus, a process cartridge system has long been employed, according to which an electrophotographic photosensitive drum (which hereinafter will be referred to as "photosensitive drum"), and a single or multiple processing means which act on the photosensitive drum are integrally disposed in a cartridge which is removably mountable in the main assembly of an image forming apparatus. Also in a process cartridge system, an electrophotographic image forming apparatus can be maintained by an operator himself without any help from a service person, tremendously improving operational efficiency. Thus, a process cartridge system is widely used in the field of electrophotographic image forming apparatuses.

It has also been known that in the case of an image forming apparatus employing a cartridge system, as a certain cover of the main assembly of the image forming apparatus is opened or closed, the process cartridge in the main assembly is moved from the image formation position (mounted position) in the main assembly to the front area (mounting position) of the main assembly, or from the front area to the image formation position, respectively (US Publication No. 2002-159790).

According to the above patent document, a cartridge is to be mounted into the movable cartridge guide or the main assembly of an image forming apparatus from the front side of the main assembly. As the cover of the main assembly is closed, the movable cartridge guide is moved by the closing movement of the cover, conveying thereby the cartridge to the image formation position (mounted position).

Therefore, it is unnecessary for an operator to push the cartridge to the inward end of the main assembly when mounting the process cartridge into the main assembly.

Thus, this mechanical arrangement drastically improves the operational efficiency of the mounting of the process cartridge into the main assembly.

The present invention is a result of further development of the above described prior art.

SUMMARY OF THE INVENTION

The primary object of the present invention is to provide a combination of a process cartridge, a mechanism for mounting a process cartridge into the image assembly of an electrophotographic image forming apparatus, and an electrophotographic image forming apparatus, which is superior, in operability regarding the mounting of a process cartridge into the main assembly, to that in accordance with the prior art.

Another object of the present invention is to provide a combination of a process cartridge, a mechanism for mounting a process cartridge into the image assembly of an electrophotographic image forming apparatus, and an electrophotographic image forming apparatus, which assures that a process cartridge is moved from the cartridge mounting position to the image formation position.

Another object of the present invention is to provide a combination of a process cartridge, a mechanism for mounting a process cartridge into the image assembly of an electrophotographic image forming apparatus, and an electrophotographic image forming apparatus, which keeps on pulling the cartridge in the cartridge insertion direction while the process cartridge is moved from the mounting position to the image formation position.

Another object of the present invention is to provide a combination of a process cartridge, a mechanism for mounting a process cartridge into the image assembly of an electrophotographic image forming apparatus, and an electrophotographic image forming apparatus, which keeps on pulling the cartridge in the cartridge insertion direction from the mounting position to the image formation position.

Another object of the present invention is to provide a combination of a process cartridge, a mechanism for mounting a process cartridge into the image assembly of an electrophotographic image forming apparatus, and an electrophotographic image forming apparatus, in which the process cartridge is mountable in the movable cartridge guides of the main assembly of an electrophotographic image forming apparatus; is movable by the movement of the movable cartridge guides from the cartridge mounting position to the image formation position; and includes a first cartridge positioning portion, which is extended from one or the lengthwise ends of the cartridge in the direction parallel to the axial line of the photosensitive drum, to be placed in contact with the main assembly of the image forming apparatus in order to properly position the cartridge relative to the apparatus main assembly, and the axial line of which coincides with that of the photosensitive drum; a second cartridge positioning portion, which is extended from the other lengthwise end of the cartridge in the direction parallel to the axial line of the photosensitive drum, to be placed in contact with the main assembly of the image forming apparatus in order to properly position the cartridge relative to the apparatus main assembly, and the axial line of which coincides with that of the photosensitive drum; and catch portions with which the latches of the apparatus main assembly are made to engage, by the movement of the movable cartridge guides of the apparatus main assembly, in order to generate force in the direction to pull the cartridge in the cartridge mounting direction.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, preferred embodiments or the present invention will be described with reference to the appended drawings. The measurements, materials, configurations of the structural components, and their positional relationships, in this embodiment, are not intended to limit the scope of the present invention, unless specifically noted. Also hereinafter, once a given element in this embodiment is described regarding its material, configuration, etc., it will be the same throughout this specification, unless specifically noted.

In the following descriptions of the preferred embodiments of the present invention, the lengthwise direction of a process cartridge means the direction intersecting with (virtually perpendicular to) the direction in which a process cartridge is mounted into, or removed from, the main assembly of an image forming apparatus. The top and bottom surfaces of a process cartridge means the surfaces of the process cartridge, which will be on the top and bottom of the process cartridge, respectively, when the process cartridge is properly situated in the main assembly.

Embodiment 1

Hereafter, referring to FIGS. 1-12, the process cartridge and electrophotographic color image forming apparatus in the first embodiment will be described.

[Description of General Structure of Electrophotographic Color Image Forming Apparatus]

First, the general structure of the color image forming apparatus will be described with reference to FIG. 2, which is a sectional view of the image forming apparatus employing an electrophotographic process in this embodiment.

Figure 2:
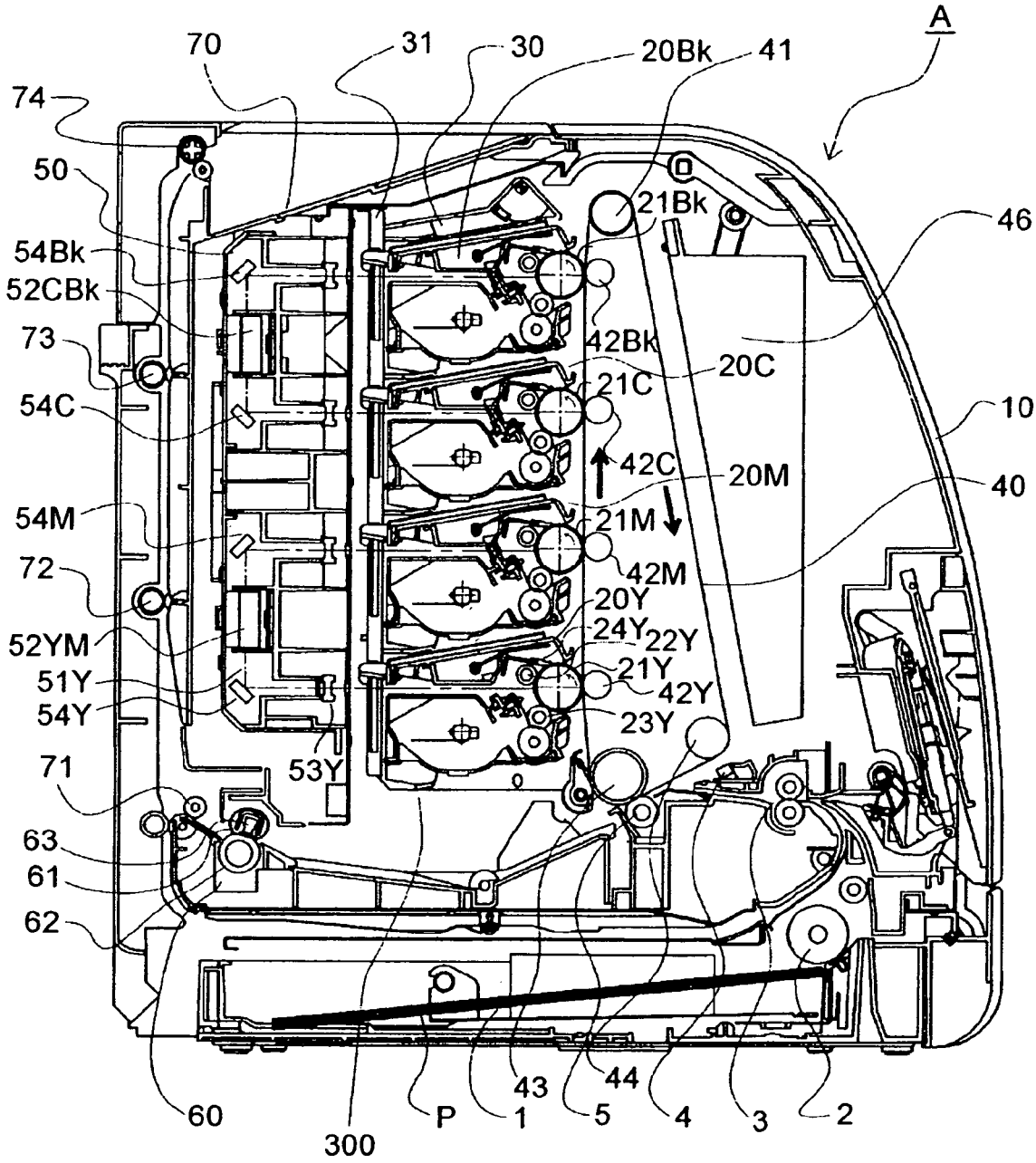
FIG. 2 is a schematic sectional view of the image forming apparatus (color laser printer) employing an electrophotographic image formation process, in the first embodiment of the present invention.

As shown in FIG. 2, the color laser printer A (which hereinafter will be simply referred to as "printer") is a four-drum type (inline type) printer, which includes four process cartridges 20 (20Y, 20M, 20C, and 20Bk) and an intermediary transfer member (medium) 40.

The four process cartridges 20 (20Y, 20M, 20C, and 20Bk) are mounted in the main assembly of the color printer A, being vertically stacked. The cartridge 20Y stores developer of yellow color, and forms an image of the yellow developer. The cartridge 20M stores developer of magenta color, and forms an image of the magenta developer. The cartridge 20C stores developer of cyan color, and forms an image of the cyan developer. The cartridge 20Bk stores developer of black color, and forms an image of the black developer. The intermediary transfer member 40 is a member onto which images formed of developers in process cartridges 20 are temporarily transferred in layers, forming an image (color image) formed of the developers different in color, and from which the image (color image) is transferred onto a recording medium P.

After the transfer of the color image onto the recording medium P, the recording medium P is conveyed to a fixing device 60. Then, in the fixing device 60, the color image is fixed to the recording medium P. Thereafter, three pairs 71, 72, and 73 of discharge rollers discharge the recording medium P, to which the color image has just been fixed, to a delivery tray 70, which is a part of the top surface of the main assembly.

The four cartridges 20 can be individually mounted into, or removed from, the main assembly A of the printer.

Figure 3:
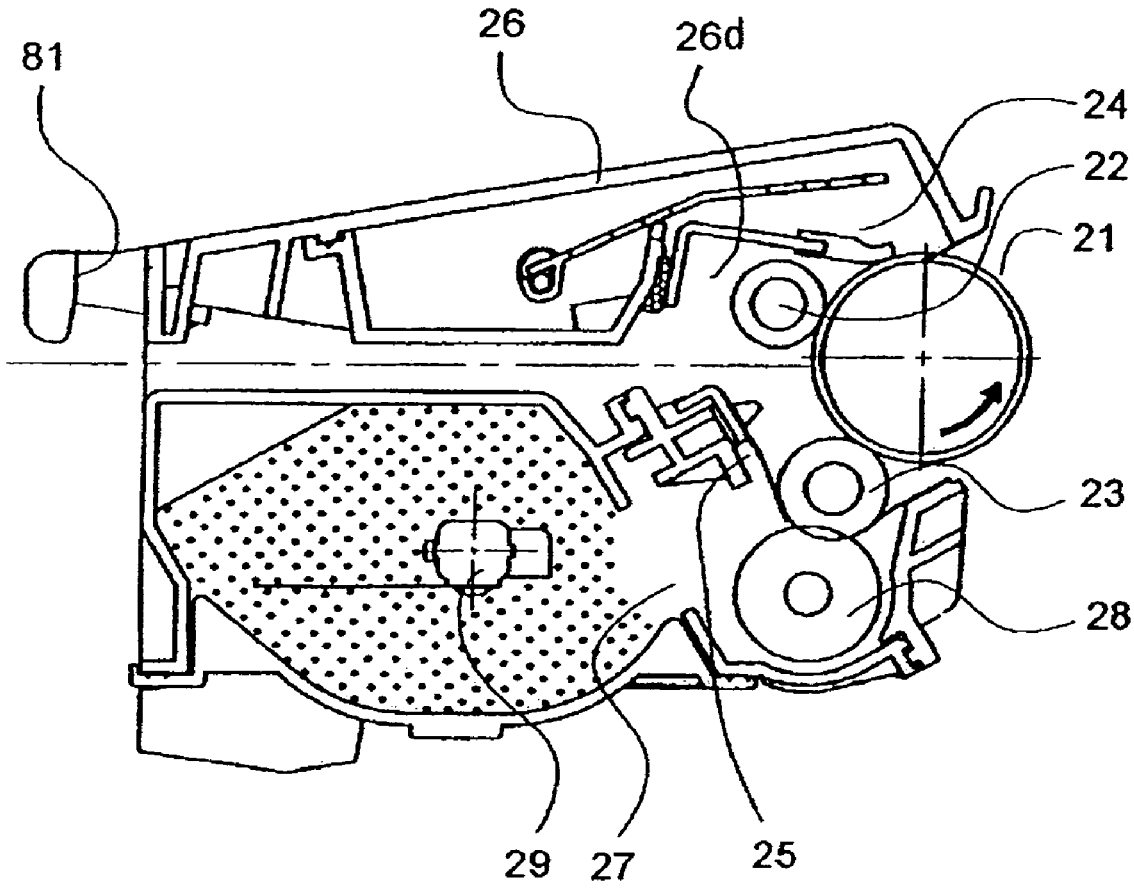
FIG. 3 is a schematic sectional view of the process cartridge in the first embodiment of the present invention.

Next, referring to FIGS. 2 and 3, the various portions of the image forming apparatus will be described in structure in a logical order. FIG. 3 is a schematic sectional view of the cartridge in this embodiment. Incidentally, where all the cartridges are the same regarding a given structural feature, only the cartridge 20Y will be described regarding this structural feature, and the other process cartridges will not be described regarding this structural feature

[Photosensitive Drum]

The photosensitive drum 21 in this embodiment comprises an aluminum cylinder, and a layer of organic photosensitive substance coated on the peripheral surface of the photosensitive drum 21. It is rotatably supported by the frame 26 of the cartridge 21. At the back side (FIG. 2) of the cartridge 20, the driving force from a cartridge driving motor (unshown) is transmitted to the lengthwise end of the photosensitive drum 21, whereby the photosensitive drum 21 is rotated in the counterclockwise direction (FIG. 3) indicated by an arrow mark in the drawing in synchronism with an image formation.

[Charging Means]

A charging means is provided with a charge roller 22 capable of applying voltage. The peripheral surface of the photosensitive drum 21 is uniformly charged by the charge roller 22.

[Exposing Means]

The photosensitive drum 21 is exposed by a scanner portion 50. The scanner portion 50 in this embodiment is provided with two polygon mirrors 52 (52YM and 52CBk), each of which is capable of guiding an image forming beam of light to two cartridges 20. Thus an image forming beam of light can be guided to the total of four cartridges 20. As image formation signals are sequentially given to a laser diode (unshown), the laser diode projects a beam of image formation light 51 (51Y) reflecting the image formation signals to the polygon mirrors 52, which are being rotated at a high speed. The image formation light 51 is reflected (deflected) by the polygon mirror 52 (52YM), and then, is reflected (deflected) by the reflective lens 54 (54Y). Then, the image formation light 51 is guided through the focal lens 53 (53Y) onto the peripheral surface of the photosensitive drum 21 (21*y*), which is being rotated a predetermined peripheral velocity. As the image formation light 51 reaches the peripheral surface of the photosensitive drum 21, the numerous points of the peripheral surface of the photosensitive drum 21 are selectively exposed, forming thereby an electrostatic latent image on the peripheral surface of the photosensitive drum 21.

[Developing Means]

The developing means has a development roller 23 (23Y), by which the aforementioned electrostatic latent image is developed. For the development of the latent image, the development roller 23 is disposed in parallel to the photosensitive drum 21, with its peripheral surface being in contact with the peripheral surface of the photosensitive drum 21, and is rotated in such direction that, in the contact area between the development roller 23 and photosensitive drum 21, the peripheral surface of the development roller 23 moves in the same direction as that of the photosensitive drum 21. The development roller 23 forms a visible image, that is, an image formed of developer, on the peripheral surface 21.

[Intermediary Transfer Member]

The intermediary transfer member 40 is a member onto which multiple images formed from developers on the photosensitive drums 21, by the developer rollers 23, one for one, are transferred in layers during color image formation. The intermediary transfer member 40 is circularly driven in the clockwise direction (FIG. 2) at the same peripheral velocity as that of the photosensitive drum 21.

After being formed on the photosensitive drums 21, the images formed from developers are transferred onto the intermediary transfer member 40 by the primary transfer rollers 42 (42Y, 42M, 12C, and 42Bk), one for one. Each transfer roller 42 is disposed so that it is kept pressed upon the corresponding photosensitive drum 21, with the intermediary transfer member 40 sandwiched between the transfer roller 42 and photosensitive drum 21.

After the multiple images formed from developers are transferred in layers onto the intermediary transfer member 40, the intermediary transfer member 40 and secondary transfer roller 5 nip the recording medium P between them, and together convey the recording medium P. As a result, the color images formed from developers, on the intermediary transfer member 40, are transferred all at once onto the recording medium P.

The intermediary transfer member (intermediary transfer belt) 40 in this embodiment is a seamless resin belt with a circumferential dimension of roughly 620 mm. It is stretched around a driving roller 41, intermediary transfer member backing roller 43, and tension roller 44, being thereby supported by them. The tension roller 44 is kept pressured outward of the loop, which the intermediary transfer member 40 forms, by the pressure applied to the lengthwise ends of the roller 44. With the provision of this structural arrangement, should the circumferential dimension of the intermediary transfer member 40 change due to the changes in the internal temperature and/or humidity, and the elapse of time, the change is absorbed by this structural arrangement, whereby the amount of the tension to which the intermediary transfer member 40 is subjected remains virtually constant.

Further, the intermediary transfer member 40 is pivotally held to the main assembly A of the apparatus (printer), being allowed to pivot about the rotational axis of the driving roller 41. The driving force from a motor (unshown) is transmitted to the back end (FIG. 2) of the driving roller 41, circularly rotating the intermediary transfer member 40 in the clockwise direction (FIG. 2) in synchronism with image formation.

[Feeding Station]

The feeding station is a station for conveying recording media P to the cartridges 20 in the main assembly A of the printer. It includes a cassette 1 capable of containing multiple recording media P, a roller 2, and a pair of registration rollers 3, etc.

During image formation, the roller 2 is rotationally driven in synchronism with image formation, whereby the recording media P in the cassette 1 are fed one by one out of the cassette 1, toward the pair of registration rollers 3, which carries out in a predetermined sequence, the process for keeping the recording medium P on standby and the process for conveying the recording medium P toward the intermediary transfer member 40, in order to make the recording medium P align with the images on the intermediary transfer member 40 during the image transfer process.

[Transfer Station]

The transfer station has a secondary transfer roller 5, which is rotationally driven, and is roughly vertically movable (FIG. 2). In synchronism with the arrival of the color images at the transfer station, the transfer roller 5 is pressed against the intermediary transfer member 40 by a cam (unshown) onto the recording medium P with the application of a predetermined amount of pressure and the recording medium P nipped between the intermediary transfer member 40 and transfer roller 5. During this process, bias is applied to the transfer roller 5. As a result, the image formed from developers, on the intermediary transfer member 40 are transferred onto the recording medium P. Incidentally, the intermediary transfer member 40 and transfer roller 5 are driven independently from each other. Therefore, after the transfer process, the recording medium P, which has been kept sandwiched by the intermediary transfer member 40 and transfer roller 5 during the transfer process, is conveyed leftward (FIG. 2), roaching a fixing device 60.

[Fixing Station]

In the fixing station, the color images formed from developers on the recording medium P are fixed to the recording medium P by the fixing device 60, which includes a film guide unit 61 and a pressure roller 62. The film guide unit 61 contains a ceramic heater 63 for heating the recording medium P. The pressure roller 62 presses the recording medium P against the film guide unit 61. With the provision of this structural arrangement, the recording medium P is subjected to heat and pressure, whereby the color images formed of developers are fixed to the recording medium P.

[Image Forming Operation]

Next, the operation for forming an image with the use of the apparatus structured as described above will be described.

First, the feed roller 2 shown in FIG. 2 is rotated, conveying thereby one of the recording media P in the cassette 1 to the pair of registration rollers 3.

Meanwhile, the photosensitive drum 21 and intermediary transfer member 40 are rotated independently of each other, in the direction indicated by the arrow (FIG. 2) at a predetermined peripheral velocity (which hereinafter will be referred to as process speed).

After being charged by the charge roller 22 across its peripheral surface the photosensitive drum 21 is exposed to the beam of laser light (image formation light). As a result, an electrostatic latent image is formed on the peripheral surface of the photosensitive drum 21.

1: Formation of Yellow Image

A latent image corresponding to the yellow color component of a target image is formed hy exposing the peripheral surface of the photosensitive drum 21Y to the beam of laser light 51Y, corresponding to the yellow color component of the target image, projected from the scanner portion 50. In synchronism with the formation of this latent image, the yellow development roller 23Y is rotated while voltage, the polarity of which is the same as that of the photosensitive drum 21Y, is applied to the yellow development roller 23Y in order to adhere yellow developer to the latent image on the photosensitive drum 21Y, that is, in order to develop the latent image with the yellow developer. The developed latent image, that is, an image formed from yellow developer, is transferred (primary transfer) onto the peripheral surface of the intermediary transfer member 40, at the location at which the transfer roller 42Y is kept pressed against the photosensitive drum 21Y, with the intermediary transfer member 40 being sandwiched between the transfer roller 42Y and photosensitive drum 21Y.

2: Formation of Magenta Image

Next, the peripheral surface of the photosensitive drum 21M is exposed to the beam of laser light, corresponding to the magenta color component of the target image, projected from the scanner portion 50, forming thereby a latent image corresponding to the magenta color component of the target image on the peripheral surface of the photosensitive drum 21M. In this case, the latent image corresponding to the magenta color component is formed so that its leading edge, in terms of the rotational direction of the photosensitive drum 21M, aligns with the leading edge, in terms of the moving direction of the intermediary transfer member 40, of the image formed of yellow toner on the intermediary transfer member 40. In synchronism with the formation of this latent image, the magenta development roller 23M is rotated to develop the latent image corresponding to the magenta color component, as was the latent image corresponding to the yellow color component. The developed latent image, that is, an image formed from magenta developer, is overlaid (primary transfer) onto the image formed from yellow developer on the peripheral surface of the intermediary transfer member 40.

3: Formation of Cyan Image

Next, a process similar to that carried out to form the magenta image is carried out to overlay an image formed of cyan developer (cyan image) onto the image formed of yellow and magenta developers, so that its leading edge aligns with the those of the yellow and magenta images on the peripheral surface of the intermediary transfer member 40.

4: Formation of Black image

Next, a process similar to that carried out to form the magenta image is carried out to overlay an image formed from black developer (black image) onto the images formed from yellow, magenta, and cyan developers, so that its leading edge aligns with the those of the yellow, magenta, and cyan images on the peripheral surface of the intermediary transfer member 40.

Reference symbols 21C and 21Bk. and reference symbols 42C and 42Bk, in the drawing designate the photosensitive drums and primary transfer rollers, respectively, corresponding to the cyan and black color components, one for one.

As described above, the process including:

the step of forming a latent image, the step of developing the latent image into a visible image, and the step of transferring the visible image onto the intermediary transfer member 40, is sequentially carried out for the yellow, magenta, cyan, and black color components of the target image, in this order.

As a result a full-color image formed of four developers, that is, yellow, magenta, cyan, and black developers, is formed on the surface of the intermediary transfer member 40.

Incidentally, prior to the completion of the transfer of the image formed from black developer onto the intermediary transfer member 40, the recording medium P, which has been kept on standby, is released by the pair of registration rollers 3 for further conveyance.

Except for the period in which the four color images are transferred onto the intermediary transfer member 40, the transfer roller 5 is kept at the bottom position, being away from the intermediary transfer member 40. However, immediately prior to the transfer of the four color images onto the intermediary transfer member 40, the transfer roller 5 is moved upward by a cam (unshown) in order to keep the recording medium P pressed against the intermediary transfer member 40 by the transfer roller 5, in the second transfer station, while the four images are transferred. Further, during the secondary transfer or the four color images, bias opposite in polarity to the developers is continuously applied to the transfer roller 5. As a result, the four color images, which make up a full-color image, on the intermediary transfer member 40, are transferred all at once onto the recording medium P.

Thereafter, the recording medium P is separated from the intermediary transfer member 40, and is conveyed to the fixing station, in which the images formed of the developers are fixed. Then, the recording medium P is discharged onto the delivery tray 70 on top of the main assembly A or the printer, by the four pairs 71, 72, 73, and, 74 of discharge rollers, ending the operation for forming a full-color image on one of the recording mediums P. Next, the process cartridge, mechanism for mounting the process cartridge, and electrophotographic image forming apparatus, in this embodiment, will be described in detail.

[Process Cartridge]

FIG. 3 is a sectional view of the cartridge 20. The cartridge 20 includes: the photosensitive drum 21, charge roller 22 as a processing means, development roller 23 as a processing means, and cartridge frame 26 in which the preceding components, etc. are integrally disposed. As the amount of the developer in the cartridge 20 in the apparatus main assembly reduces to a critical level, it is to be replaced by an operator to maintain a high level of image quality. The inline full-color image forming apparatus in this embodiment employs four process cartridges 20, that is, yellow, magenta, cyan, and black process cartridges (20Y, 20M, 20C, and 20Bk), which are independent of each other. The four process cartridges 20 differ in development color and become different in the length of service life, depending on the types of the images outputted by the image forming apparatus. Therefore, designing the image forming apparatus so that it can employ four process cartridges different in development color and independent of each other makes it possible to use each of the four types of process cartridges more efficiently.

In this embodiment, the photosensitive drum 21, the cleaning blade 24, and the charge roller 22 are supported by the drum frame 26*d* as a part of the cartridge frame 26, whereas the stirring member 29 for stirring developer, the development roller 23, sponge roller 28 for supplying the developer roller 23 with developer, and development blade 25 for regulating the amount by which developer is kept on the development roller 23, are supported by the development frame 27, which is another part of the cartridge frame 26. The developer storage portion for storing developer is a part of the development frame 27.

In other words, the cartridge frame 26 in this embodiment comprises the drum frame 26*d* and development frame 27.

[Method for Mounting Process Cartridge]

Figure 4:
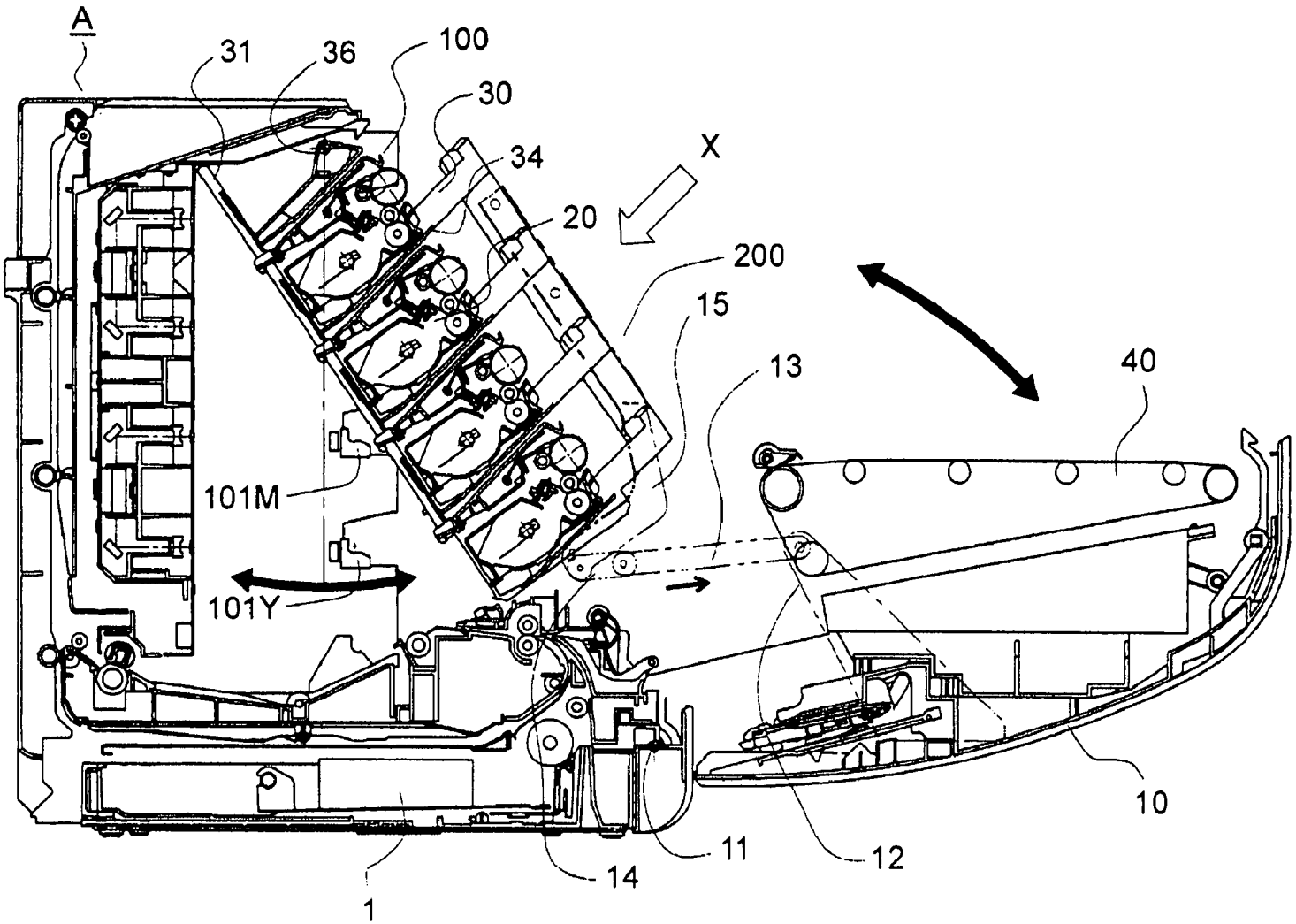
FIG. 4 is a schematic sectional view of the image forming apparatus, the cover of which is open, in the first embodiment of the present invention.

FIG. 4 is a sectional view of the image forming apparatus in this embodiment, the cover of which is open.

As shown in FIG. 4, the rotational axis 11 about which the cover 10 of the main assembly A of the image forming apparatus can be rotated is in the bottom front end portion of the main assembly A. The intermediary transfer member 40 is attached to the cover 10. Therefore, as the cover 10 is opened, the intermediary transfer member 40 rotates about the rotational axis 11, along with the cover 10, allowing thereby an operator to access the cartridges 20 (20Y, 20M, 20C, and 20Bk).

The cover 10 is to be opened or closed when necessary to mount a single cartridge or multiple cartridges 20 into the apparatus main assembly A, or to remove a single cartridge or multiple cartridges 20 from the apparatus main assembly A.

The apparatus main assembly A is provided with a pair of movable cartridge guides 30 and 32, which together hold cartridges 20 (20Y, 20M, 20C, and 20Bk). The rotational axes 36 of the movable cartridge guides 30 and 32 are in the top portion of the apparatus main assembly A. The movable cartridge guides 30 and 32 are mechanically connected to the cover 10 with a linking mechanism. Thus, the movable cartridge guides 30 and 32 are moved by the movement of the cover 10, as the cover 10 is opened. The movable cartridge guides 30 and 32 are pivoted at a predetermined angle (roughly 35° in this embodiment) about the rotational axes 36 from the image formation position 300 (FIG. 2) to the cartridge mounting position 200 (FIG. 4) at which they are held while holding the cartridges 20 (20Y, 20M, 20C, and 20Bk) are mounted into, or removed from, the movable cartridge guides 30 and 32.

As for the locations of the movable cartridge guides 30 and 32 relative to the apparatus main assembly A, the movable cartridge guide 30 is at one end of the apparatus main assembly A in terms of the direction perpendicular to the direction in which the cartridges 20 are mounted into the apparatus main assembly A, and the movable cartridge guide 32 is at the other end. The movable cartridge guide 30 holds each cartridge 20 by one end of the cartridge 20 in terms of the lengthwise direction of the cartridge 20, and the movable cartridge guide 32 holds each cartridge 20 by the other end. Further, the movable guides 30 and 32 are moved by the movement of the cover 10 as described above.

The guides 30 and 32 are provided with cartridge mounts 34 and 35, respectively, on which the cartridge 20 is mounted. When the movable cartridge guides 30 and 32 are in the image formation position 300 (FIG. 2), the mounts 34 and 35 are tilted roughly 10° relative to the horizontal plane, whereas when the movable cartridge guides 30 and 32 are in the cartridge mounting position 200 (FIG. 4) in which the cartridge 20 is mounted into the guides 30 and 32, the mounts 34 and 35 are tilted roughly 45° relative to the horizontal plane.

When removing the cartridge 20 from the apparatus main assembly A, the cartridge mounting position 200 (FIG. 4) serves as the position in which the cartridge 20 is removed from the guides 30 and 32.

When mounting the cartridge 20 into the apparatus main assembly A, or removing the cartridge 20 from the apparatus main assembly A, the cartridge 20 is to be inserted onto, or removed from, the mounts 34 and 35 in the direction parallel to the mounts 34 and 35, while keeping the apparatus main assembly A in the state shown in FIG. 4. In other words, when mounting the cartridge 20 into the guides 30 and 32, or removing the cartridge 20 from the guides 30 and 32, an operator can hold the process cartridge 20 at an angle of roughly 45° relative to the horizontal direction.

Therefore, there is no obstruction in the direction in which the cartridge 20 is inserted or extracted, making it easier for an operator to insert or extract the cartridge 20. Further, the guides 30 and 32 are tilted roughly 40°. Therefore, as the cartridge 20 rests on the entrance portions of the guides 30 and 32, the cartridge 20 automatically slides inward of the mounts 34 and 35 (guides 30 and 35).

Then, the cartridge 20 stops as it hits the ends (surface 30*a*) of the mounts 34 and 35. In other words, the above described structural arrangement makes the process for mounting the cartridge 20 into the movable cartridge guides 30 and 32 intuitive to an operator, while assuring that the process cartridge 20 is properly mounted into the movable cartridge guides 30 and 32.

The mount 34 is a part of the movable cartridge guide 30, whereas the mount 35 is a part of the movable cartridge guide 32 (FIG. 4). Thus, one end of the cartridge 20 rests on the mount 34, and the other end of the cartridge 20 rests on the mount 35.

Next, referring to FIGS. 7 and 8, the first portions of the cartridge 20, by which the cartridge 20 contacts the movable cartridge guides 30 and 32 to be supported by the movable cartridge guides 30 and 32 will be described.

The first contact portions 26*a* and 30*b* (FIG. 7) of the cartridge 20, by which the cartridge 20 is supported by the movable cartridge guide 30 are at the lengthwise end of the process cartridge 20, from which the cartridge 20 is driven (lengthwise end having coupling 87).

Figure 1:
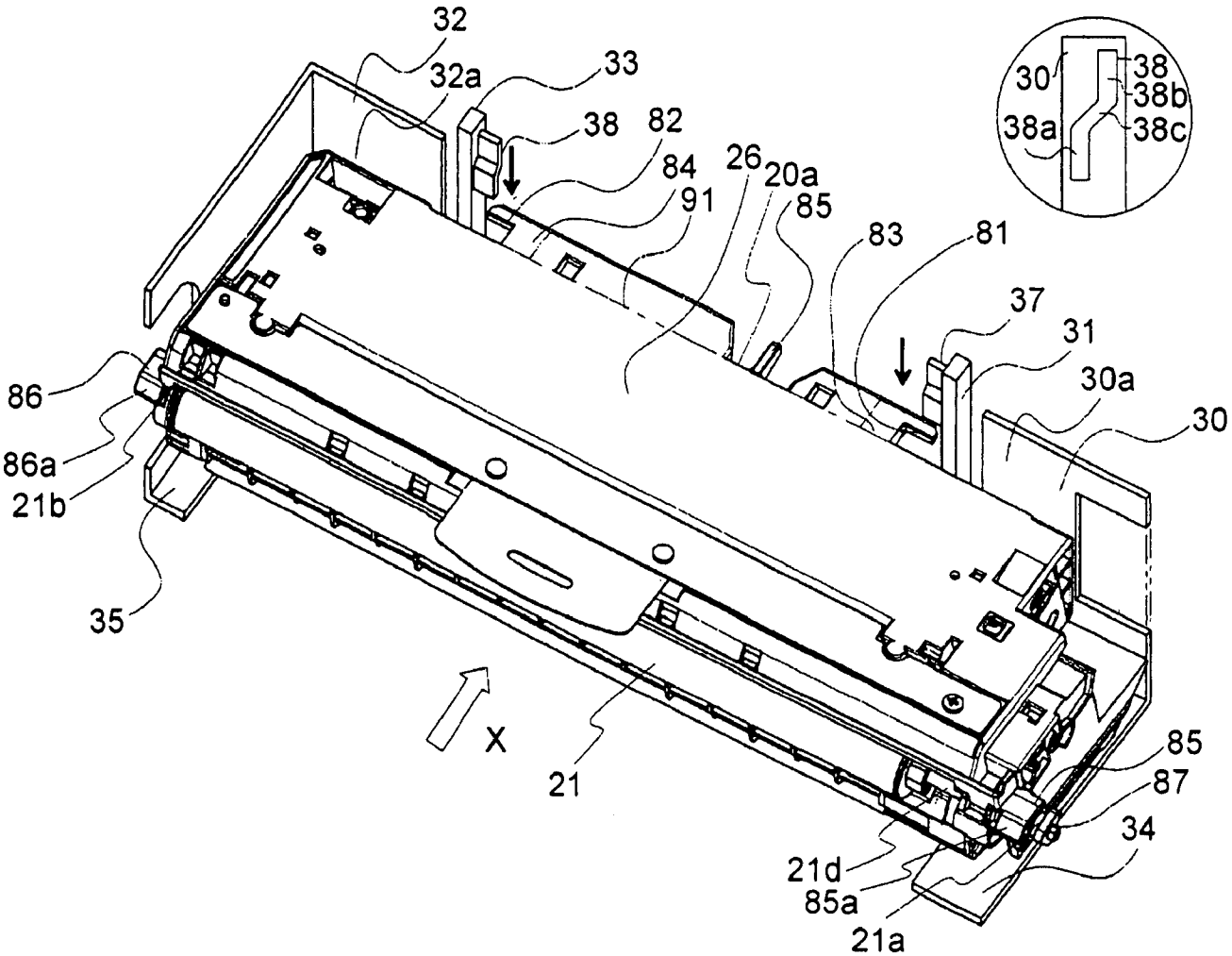
FIG. 1 is a schematic perspective view of the process cartridge, being held by the movable cartridge guide of the main assembly of an image forming apparatus, in a first embodiment of the present invention.

Further, the first contact portions 26*a* and 30*b* are integral parts of the drum frame 26*d* which is a part of the cartridge frame 26, and are supported by the mount 34 of the first movable cartridge guide 30 (FIG. 1).

The second contact portions 26*b*, 26*c*, 27*a*, and 27*b* (FIG. 8), by which the cartridge 20 is supported by the movable cartridge guide 32 are at the other lengthwise end of the process cartridge 20, more specifically, the lengthwise end from which the cartridge 20 is not driven (lengthwise end without coupling 87). They are also parts of the cartridge frame 26.

They are supported by the mount 35 of the second movable cartridge guide 32 (FIG. 1).

Next, the steps to be followed to rest the first and second contact portions of the cartridge 20, by which the cartridge 20 is rested on the mounts, will be described.

First, the step for resting the first contact portion 26*a* and 30*b* on the mount 34 will be described with reference to FIG. 7.

Figure 7:
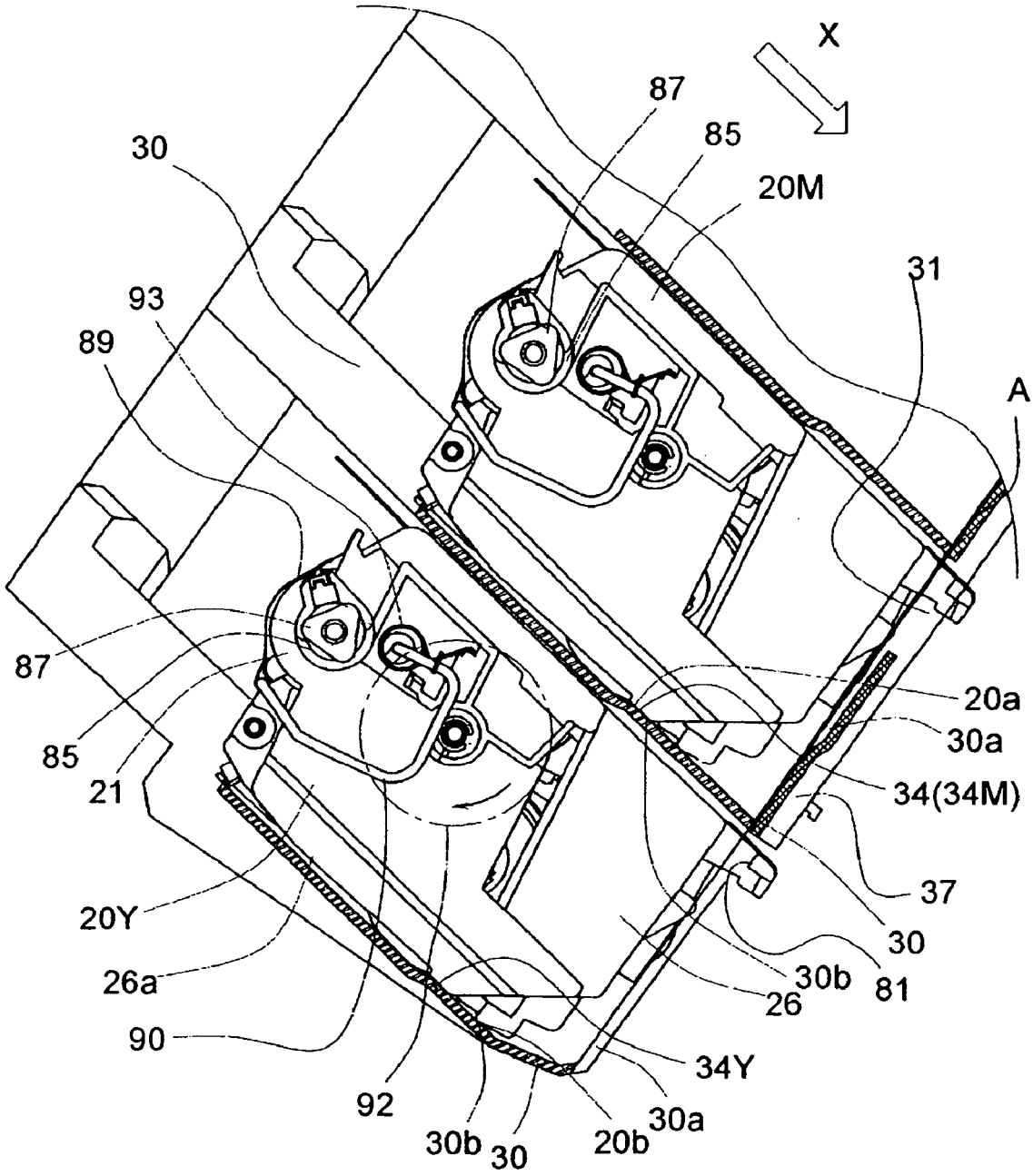
FIG. 7 is a right side view of an essential portion of the movable cartridge guide, in which the cartridges have been mounted.

Referring to FIG. 7, one of the lengthwise ends of the cartridge 20 is to be rested in the first movable cartridge guide 30, and then, to be pushed inward of the movable cartridge guide 30 (direction of arrow mark X), to make the cartridge 20 slide inward, so that the first contact portions 26*a* and 30*b* will be supported by the mount 34. The first contact portion 26*a* is an integral part of the bottom wall of the drum frame 26*d*.

The first contact portion 30*b* is a rotation controller, and prevents the cartridge 20 from rotating while the cartridge 20 is receiving driving force from the apparatus main assembly A.

Next, the step for resting the second contact portions 26*b*, 26*c*, 27*a*, and 27*b* on the mount 35 will be described with reference to FIG. 8.

Figure 8:
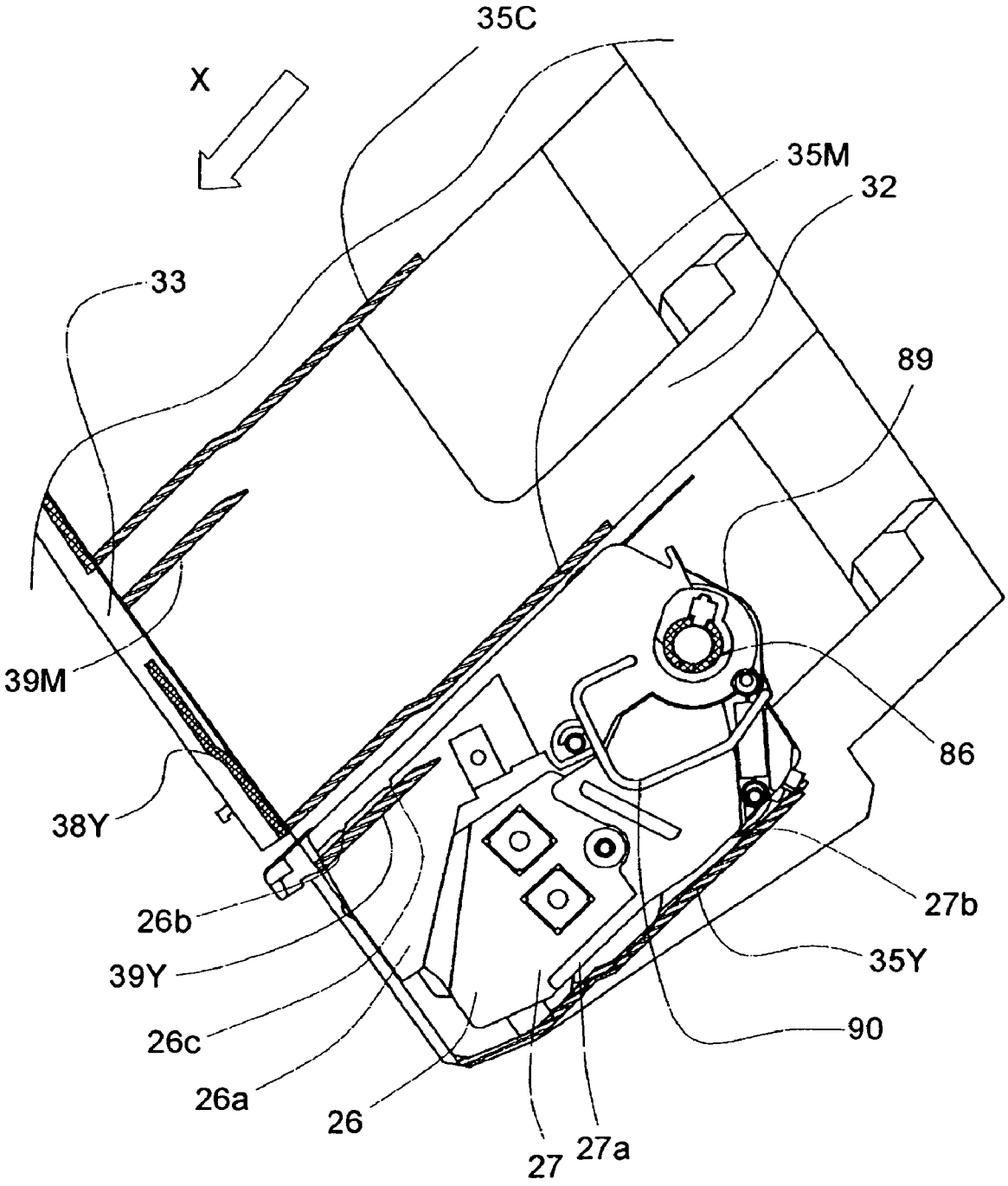
FIG. 8 is a left side view of an essential section of the movable cartridge guide, in which the cartridges have been mounted.

Referring to FIG. 8, the other lengthwise end of the cartridge 20 is to be rested in the second movable cartridge guide 32, and then, to be pushed inward of the movable cartridge guide 32 (direction of arrow mark X) to make the cartridge slide inward. As the cartridge 20 is pushed inward, the cartridge 20 moves inward, with the rest of the second contact portions of the cartridge 20, that is, the portions 27*a* and 27*b* of the bottom wall of the development frame 27, by which the cartridge 20 is supported by the movable cartridge guide 32, sliding on the mount 35.

Then, the second portions 26*b*, 26*c*, 27*a*, and 27*b*, by which the cartridge 20 is supported by the movable cartridge guide 32, climb onto the guiding rib 39 (mount 35); the second portions 26*b*, 26*c*, 27*a*, and 27*b* of the cartridge 20 come to rest on the guiding rib 39 (mount 35).

These second contact portion 27*a* and 27*b*, by which the cartridge 20 is supported by the movable cartridge guide 32, are integral parts of the bottom wall of the development frame 27 of the cartridge frame 26. The second contact portions 26*b* and 26*c*, by which the cartridge 20 is supported by the movable cartridge guide 32, are bottom surfaces of the two projections, one for one, of the top portion of the drum frame 26*d*.

It is not mandatory that the first and second contact portions of the cartridge 20, by which the cartridge 20 is supported by the movable cartridge guides 30 and 32, are formed as described above; any form may be employed as long as the form allows the cartridge 20 to be properly supported by the movable cartridge guides 30 and 32.

[Method for Solidly Positioning Process Cartridge in Printer Main Assembly]

Figure 5:
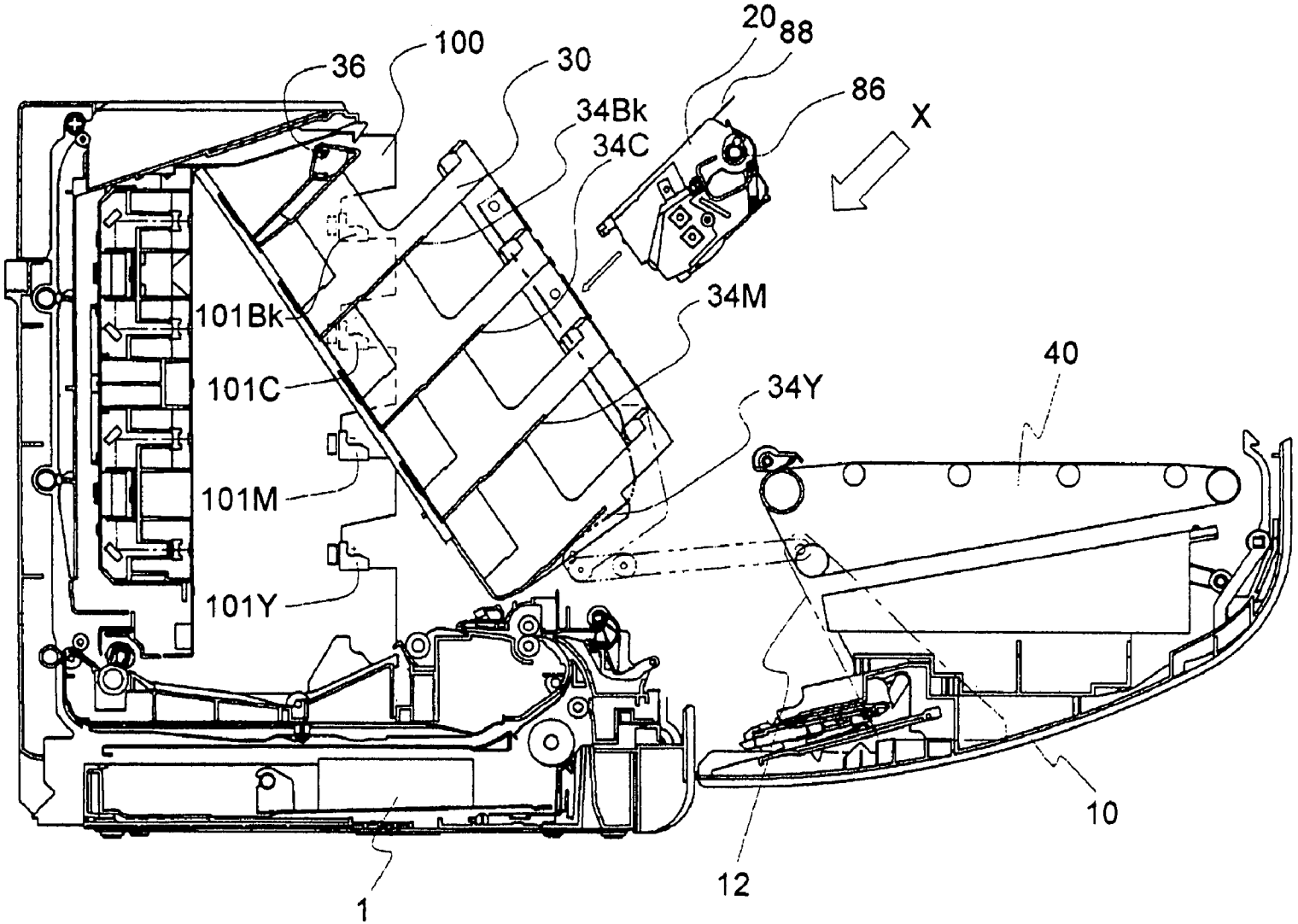
FIG. 5 is a schematic sectional view of the image forming apparatus, the cover of which is open, in the first embodiment of the present invention.
Figure 6:
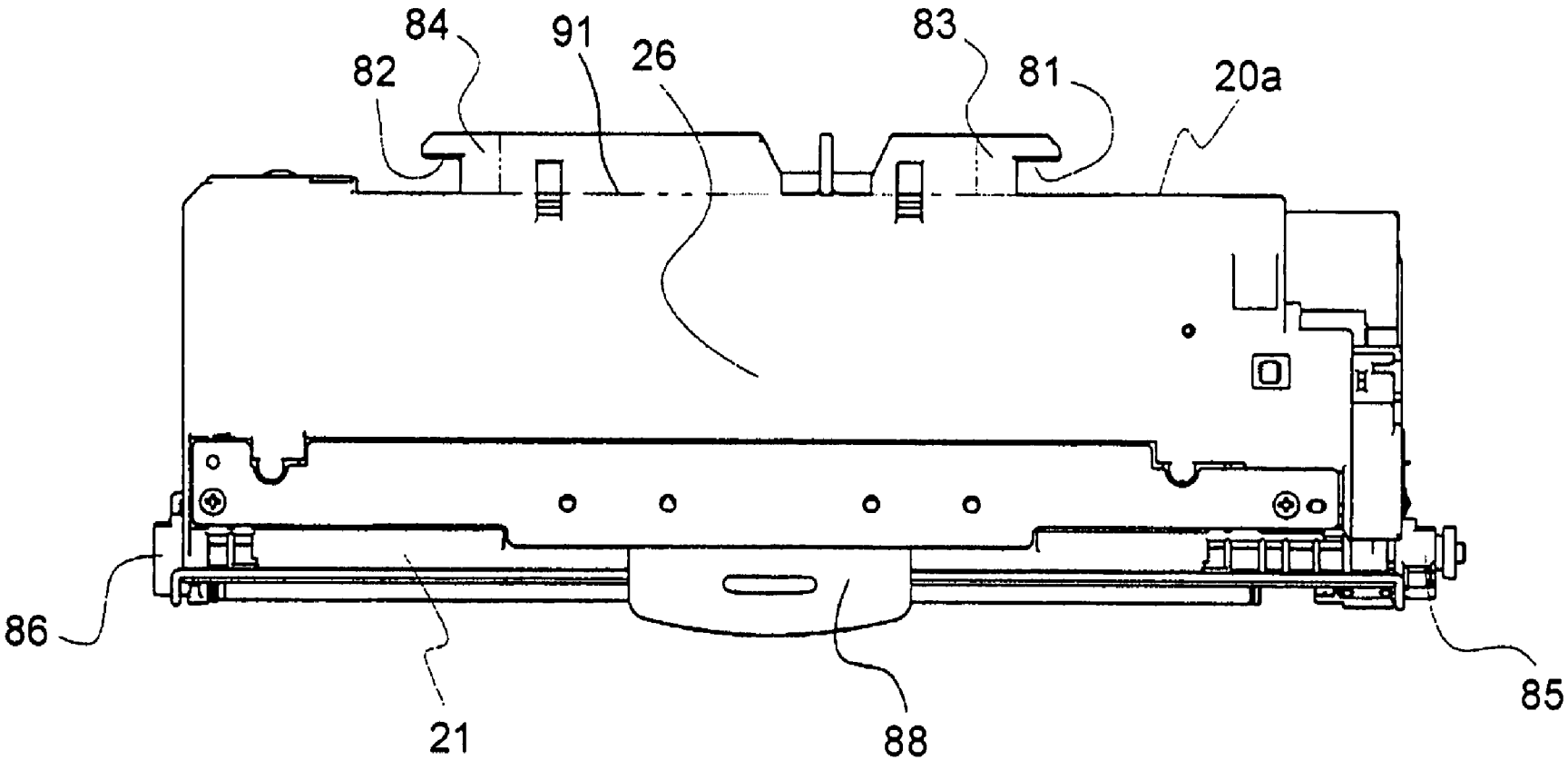
FIG. 6 is a top view of the process cartridge in the first embodiment of the present invention.

FIG. 1 is a schematic perspective view of the process cartridge properly positioned in the movable cartridge guides of the apparatus main assembly, with the cover 10 being in the open position (FIG. 4). FIG. 5 is a schematic sectional view of the image forming apparatus in this embodiment, the cover 10 of which is open. FIG. 6 is a top view of the process cartridge in this embodiment.

Incidentally, the cover 10 is to be opened or closed in order to mount the process cartridge into the apparatus main assembly A, or remove the process cartridge therefrom.

In this embodiment, the movable cartridge guides 30 and 32 are made independent of each other for cost reduction. However, they may be formed as the two portions of a movable single-piece cartridge guide, or may be formed as the two portions of a movable multi-piece cartridge guide.

Also in this embodiment, the movable cartridge guides 30 and 32 are connected by a linking member, which will be described later, so that they will remain synchronized in movement as if they are two parts of a movable single-piece cartridge guide.

Both the movable right cartridge guide 30 and movable left cartridge guide 32 are provided with cartridge mounts 34 and 35, respectively, for supporting the cartridge from below to make it possible for the cartridge to be smoothly inserted into the movable cartridge guides 30 and 32.

Referring to FIG. 6, the cartridge frame 26 is provided with cartridge positioning 85 and 86 for accurately positioning the cartridge 20 relative to the apparatus main assembly A. These positioning portions 85 and 86 project outward from the ends of the cartridge frame 26, in terms of the lengthwise direction of the photosensitive drum 21.

Further, the cartridge positioning portions 85 and 86 accurately position the lengthwise ends 21*a* and 21*b* of the drum shaft 21*d* put through the photosensitive drum 21, relative to the cartridge frame 26, while allowing the drum shaft 21*d* to be rotated. More specifically, the positioning portions 85 and 86 are provided with bearings 85*a* and 86*a*, respectively, with which the lengthwise ends 21*a* and 21*b* of the drum shaft 21*d* are rotatably supported by the cartridge frame 26 (positioning portions 85 and 86); the positioning portions 85 and 86 are accurately positioned relative to the apparatus main assembly A by the bearings 85*a* and 86*a*.

The lengthwise end 21*a* of the drum shaft 21*d*, which is extending outward from the right positioning portion 85, is provided with a coupling 87 through which driving force is transmitted to the photosensitive drum 21 from the driving means on the apparatus main assembly side.

In this embodiment, the cartridge positioning portions 85 and 86 are positioned so that their axial lines coincide with the axial line of the photosensitive drum 21. The positioning portion 85 is at one of the lengthwise ends of the photosensitive drum 21, and the positioning portion 86 is at the other lengthwise end of the photosensitive drum 21. The positioning portions 85 and 86 are the peripheral surfaces of the bearings 85*a* and 86*a*, respectively, which support the drum shaft 21*d*.

Referring to FIGS. 4 and 5, the right side wall 100 of the apparatus main assembly A is provided with process cartridge positioning members 101 (101Y, 101M, 101C and 101Bk), and the left side wall 110 of the apparatus main assembly A is also provided with process cartridge positioning members 101 (unshown). When the cartridge positioning members 101 of the left and right side walls 100 and 110 of the apparatus main assembly A are fixed to the left and right side walls, they are adjusted in position so that, as the cartridges 20Y, 20M, 20C, and 20Bk are mounted into the movable cartridge guides 30 and 32, the drum shafts 21*d* in the cartridges are positioned in parallel with a high level of accuracy.

Each cartridge positioning portion 101, which engages with the positioning portions 85 or 86 extending from one or the other of the lengthwise ends of the cartridge 20, is attached to the inward surface of the side wall of the apparatus main assemble A, projecting inward of the apparatus main assembly A.

The cartridge positioning member 101 is provided with two cartridge catching surfaces: horizontal cartridge catching surface 101*a* and vertical cartridge catching surface 101*b* (FIG. 12), by which the bearings 85*a* and 86*a* of the right anti left positioning portions 85 and 86, respectively, extending from the lengthwise ends one for one of, the cartridge frame 26. are directly caught. Because the frame 26 of each cartridge is directly supported by the side walls 100 and 110 of the apparatus main assembly A as described above, the photosensitive drum 21 in each cartridge is accurately positioned relative to the apparatus main assembly A.

In other words, it is possible to position the four photosensitive drums 21 with a higher degree of parallelness.

Referring to FIGS. 1 and 6, the cartridge frame 26 is provided with a pair of projections (which functions as catches for sliding latches) 81 and 82, which are located a small distance away from the main portion (contour 91) of the cartridge frame 26. While the cartridge is moved from the cartridge mounting position to the image formation position, the pair of projections 81 and 82 are continuously subjected to the external force which acts in the cartridge mounting direction. The contour 91 simply means the external surface of the cartridge frame 26, and does not need to be straight as Shown in FIG. 6.

In this embodiment, the right projection 81 extends from the right edge of the larger projection 83 of the cartridge frame 26, roughly in parallel to the photosensitive drum 21. For the sake of external appearance and reinforcement, the distance the larger projection 83 is extended toward the center of the cartridge frame 26 in terms of the lengthwise direction. However, the dimension of the right projection 83 in terms of the lengthwise direction may be only up to the broken line 111 the drawing. Similarly. the left projection 82 extends from the left edge of the larger projection 84 of the cartridge frame 26. roughly in parallel 1.0 the photosensitive drum 21.

The apparatus main assembly A is provided with a pair of sliding latches 31 and 33, which are attached to the movable cartridge guides 30 and 32, being enabled to slide along the movable cartridge guides 30 and 32, respectively. The pair of sliding latches 31 and 33 are provided with latch extensions 37 and 38, respectively, which engage with the above described projections (catches) 81 and 32, respectively, of the cartridge frame 26.

The latch extensions 37 and 38 engage with the projections (catches) 81 and 82, respectively.

The sliding latches 31 and 33 are moved by the closing movement of the cover 10 in the direction indicated by the arrow mark (FIG. 1), that is, downward from the position in which the latch extensions 37 and 33 are located higher than the top surfaces of the projections (latches) 81 and 82 of the cartridge 20.

As the sliding latches 31 and 33 are moved downward, the latch extensions 37 and 38 engage with the projections (catches) 81 and 82. Conversely, as the cover 10 is opened, the sliding latches 31 and 33 are moved upward by the opening movement of the cover to, causing the latch extensions 37 and 38 to disengage from the projections (catches) 81 and 82; the cartridge 20 is unlocked from the apparatus main assembly A. Since, the projections (catches) 81 and 82 are a small distance away from the main portion (contour 91) of the cartridge frame 26, the cartridge frame 26 does not interfere with the engagement between the projections (catches) 81 and 82, and the sliding latches 31 and 33, respectively.

Incidentally, the positional relationship in which the cartridge is mounted relative to the mounts 34 and 35 is not always exactly the same. Thus, in order to assure that the latch extensions 37 and 38 will properly engage with the projections (catches) 81 and 82, respectively, despite the variance in the positional relationship between the cartridge 20 and the mount 34, and/or between the cartridge 20 and mount 35, the latch extensions 37 and 38 are provided with first portion 37*a* and 38*b*, respectively, which are positioned closer to the cartridge 20 than the other portions of the latch extensions 37 and 38. The latch extensions 37 and 38 are also provided with second portions 37*b* and 38*b*, and guiding portions 37*c* and 38*c*, respectively. The second portions 37*b* and 38*b* lock with the projections (catches) 81 and 82 to keep the cartridge locked in position while the cartridge is moved from the cartridge mounting position to the image formation position. The guiding portions 37*c* and 38*c* are the portions between the first portions 37*a* and 38*a*, and second portions 37*b* and 38*b*, respectively. They are slanted in such a direction that as the latches 31 and 32 are moved downward, they pull the cartridge 20, along with the movable cartridge guides 30 and 32, toward the sliding latches 31 and 33, making it possible for the second portions 37*b* and 38*b* to lock the cartridge 20 in position while the cartridge 20 is moved from the cartridge mounting position 200 to the image formation position 300.

As the sliding latches 31 and 33 begin to be moved downward by the closing movement of the cover 10, the first portions 37*a* and 38*a* of the latches proper 37 and 38 enter the gaps between the leading surface 20*a* of the cartridge 20, and the projections (catches) 81 and 82, respectively, preventing thereby the cartridge 20 from being separated from the movable cartridge guides 30 and 32 by the reactive force generated by the driving portion, projections, etc., of the apparatus main assembly A, during the rest of the cartridge mounting operation.

The first portions 37*a* and 38*a* of the latches proper 37 and 38 are located closer to the movable cartridge guides 30 and 32 than the second portions 37*b* and 38*b* of the latch extensions 37 and 38, so that even if the cartridge 30 is mounted in the movable cartridge guides 30 and 32, slightly offset from the normal position, the first portions 37*a* and 38*a*. that is, the end portions, of the latch extensions 37 and 38 are allowed to smoothly enter the gap between the leading surface 20*a* of the cartridge 20 and the projection (catch) 81, and the gap between the rear leading 20*a* of the cartridge 20 and the projection (catch) 82, without colliding with the projections (catches) 81 and 82, respectively, as the first portions 37*a* and 38*a* are moved downward.

As the sliding latches 30 and 33 are lowered further after the entrance or the first portions 37*a* and 38*a* into the gap between the leading surface 20*a* of the cartridge 20 and the projection (catch) 81, and the gap between the leading surface 20*a* of the cartridge 20 and the projection (catch) 82, respectively, the guiding portions 37*c* and 38*c* come into contact with the projections (catches) 81 and 82, respectively. Thus, as the sliding latches 30 and 33 are moved further downward, force which acts in the direction to press the cartridge 20 against the mounts 34 and 35, and force which acts in the direction to pull the cartridge 20 toward the inward end portion 30*a* and 32*a* the right and movable left cartridge guides 30 and 32, that is, forces which act in the direction to pull the cartridge inward of the apparatus main assembly A, are generated.

Incidentally, the guiding portions 37*c* and 38*c* are desired to be shaped so that they allow the projections (catches) 81 and 82 to smoothly slide thereon from the portions 37*a* and 38*a* to the portions 37*b* and 38*b*, respectively. In this embodiment, the guiding portions 37*a* and 38*c* are slanted so that the closer a given point or the guiding portion 37*a* or 38*c* to the second portion 37*b* or 38*b*, respectively, the smaller the distance between the given paint and the projection (catch) 81 or 82.

Next, how the cartridge 20 is positioned while it is mounted will be described in detail. FIG. 7 is a side view of a part of the movable right cartridge guide, in this embodiment. which is holding the cartridge(s) in accordance with this embodiment. FIG. 7 is a side view of a part of the movable left cartridge guide, in this embodiment. which is holding the cartridge(s) in accordance with this embodiment.

FIGS. 7 and 8 are side views of the parts of the movable cartridge guides which are holding the cartridges 20 (20Y and 20M). The hatched portions in FIGS. 7 and 8 schematically show the mounts 34 and 35, and latch extensions 37 and 38, which engage with the cartridge 20.

Incidentally, the mount 35 and latch extensions 38 are on the side opposite to the side shown in the drawings. Therefore, they are not shown in FIG. 7.

Referring to FIG. 7, virtually the entirety of the lengthwise end of the cartridge is covered with the cartridge frame 26.

Referring to FIGS. 7 and 8, the mount 34 is roughly straight, and roughly parallel to the bottom wall of the cartridge frame 26, with the presence of a certain amount of gap between the mount 34 and the bottom wall of the cartridge frame 26. Therefore, when an operator mounts the cartridge 20 into the movable cartridge guide 30, the cartridge slides on the mount 34 toward the inward end of the movable cartridge guide 30 and stops as it hits the rear (inward) wall 30*n* of the movable cartridge guide 30.

The downstream portion of the mount 34 (34Y and 34M), in terms of the cartridge mounting direction, has a step with a height difference of roughly 1 mm. With the presence of this step on the mount 34, the cartridge 20 is allowed to make contact with the guide 30 only by the limited area (contact area) of its surface, while it is in the movable cartridge guide 30. This limited area (contact area) of the surface of the cartridge 20 functions as a rotation control area for preventing the cartridge 20 from rotating after the proper positioning of the cartridge 20 relative to the apparatus main assembly A.

More specifically as the cartridge 20 receives driving force from the apparatus main assembly A, the driving force acts in the direction to rotate the cartridge 20 about the axial lines of the positioning portions 85 and 86, causing thereby the cartridge frame 26 to come into contact with the rotation control area (contact portion) 32*b*. As a result, the cartridge 20 is prevented from rotating further, being thereby fixed in the position relative to the movable cartridge guide 30.

On the right side of the image forming apparatus, the apparatus main assembly A and cartridge 20 are connected to each other so that driving force can be transmitted from the apparatus main assembly A to the cartridge 20. More specifically, the driving force is transmitted from the apparatus main assembly A to the photosensitive drum 21 of the cartridge 20 through the coupling 87, which is attached to the drum shaft 21*d*, and the axial line of which coincides with that of the drum shaft 21*d*. To the development roller 23, the driving force is transmitted through the input gear 92 (contoured by singe-dot broken line in drawing), the axial line of which coincides with the pivotal center of the development frame 27. The gear 92 is driven in the clockwise direction indicated by an arrow mark (FIG. 7). Therefore, as the driving force is transmitted, the cartridge 20 is rotated in the direction to cause the cartridge 20 to be supported by the right cartridge positioning portion 85, and the aforementioned cartridge rotation control surface (contact portion) 30*b* as a cartridge movement regulating portion. As a result, the cartridge 20 is kept stable in position while the driving force is transmitted thereto from the apparatus main assembly A; in other words, the cartridge 20 is kept accurately positioned relative to the apparatus main assembly A during an image forming operation.

The movable right cartridge guide 30 is provided with the sliding latch 1, which is slidably attached to the movable cartridge guide 30.

FIG. 8 is a schematic side view of the combination of the movable left cartridge guide 32 and the cartridge 20Y in the movable left cartridge guide 32. The movable left cartridge guide 32 and left end portion of the process cartridge 20 will be described only regarding the portions different from those of the movable right cartridge guide 30 and the right end portion of the process cartridge 20.

The left end portion of the cartridge 20 is different from the right end portion thereof in that it includes the top half which is the drum frame 26*d*, and the bottom half, which is the development frame 27 pivotally connected to the drum frame 26*d*. Therefore, as the cartridge 20 is inserted into the movable cartridge guide 32, the bottom wall of the development frame 27 slides on the mount 35 of the movable left cartridge guide 32.

As the cartridge 20 is slid on the movable cartridge guide 32 deeper into the movable cartridge guide 32, the rib, with which the top portion on of the leading end, in terms of the cartridge mounting direction, of the cartridge frame 26 is provided, smoothly slides onto the guide rib 39 (39Y, 39M) of the movable cartridge guide 32. Then, as the cartridge 20 is slid deeper into the movable cartridge guide 32, the cartridge 20 is fixed in position by the positioning portions 85 and 86, the axial lines of which coincide with that of the axial line of the drum shaft 21*d*, and the rotation control area 20*b* which is in contact with the cartridge rotation control area (30*b*) of the mount 34 (34Y and 34M) shown in the drawing of the movable right cartridge guide. Thus, after the proper positioning of the cartridge 20 in the apparatus main assembly A, there will be no contact between the mount 35 of the movable cartridge guide 32, shown in the drawing of the movable left cartridge guide, and the cartridge 20.

The cartridge rotation control area 20*b* of the cartridge 20 is such a portion of the external surface of the cartridge 20 that belongs to the downstream side of the cartridge 20, in terms of the cartridge mounting direction, and is at the right lengthwise end (which is provided with coupling 85, and from which cartridge receives driving force from apparatus main assembly A) of the cartridge 20. Further, the cartridge rotation control area 20*b* is a part of the exterior of the bottom wall of the cartridge frame 26.

In FIGS. 1, 4, 5, 7, 8, and 12 the direction indicated by the arrow mark X is the direction in which cartridge is mounted, and the direction opposite thereto is the direction in which cartridge 20 is extracted from the apparatus main assembly A.

The movable cartridge guide 32 is provided with the sliding latch 33, which is slidably attached to the movable cartridge guide 32 as is the sliding latch 31 attached to the movable cartridge guide 30.

[Sliding Latch]

Next, the movable cartridge guides 30 and 32, the connection of the movable cartridge guides 30 and 32 to the linking mechanism, and the movement of the movable cartridge guides 30 and 32, will be described.

FIG. 4, which is a schematic sectional view of the image forming apparatus in this embodiment, shows the mechanical linkage which connects the movable right cartridge guide 30 to the Cover 10.

Designated by a reference number 15 is a connective rod as a linking member, connected to the movable right cartridge guide 30. The connective rod 15 is roughly in the shape of a letter L. It is attached to the movable right cartridge guide 30 by its long portion, whereas the short portion, that is, the portion roughly perpendicular to the long portion, extends in the inward direction of the movable right cartridge guide 30. The end of the short portion of the connective rod 15 is connected to a rotational rod 14 for delaying the movement of the connective rod (movable right cartridge guide 30) a predetermined length of time relative to the beginning of the opening movement of the cover 10. To the rotational rod 14, one end of an intermediary connective rod 14; is connected, and the other end of the intermediary connective rod 13 is collected to the door lever 12 integral with the cover 10.

The time lag between the beginning of the opening of the cover 10 and the beginning of the movement of the connective rod 15 (movable right cartridge guide 30) is used for disengaging the couplings which transmit the force for circularly driving the intermediary transfer belt 40 to the driving roller 41, and also, for disengaging the couplings which transmit driving force to the foul photosensitive drums 21.

Figure 9:
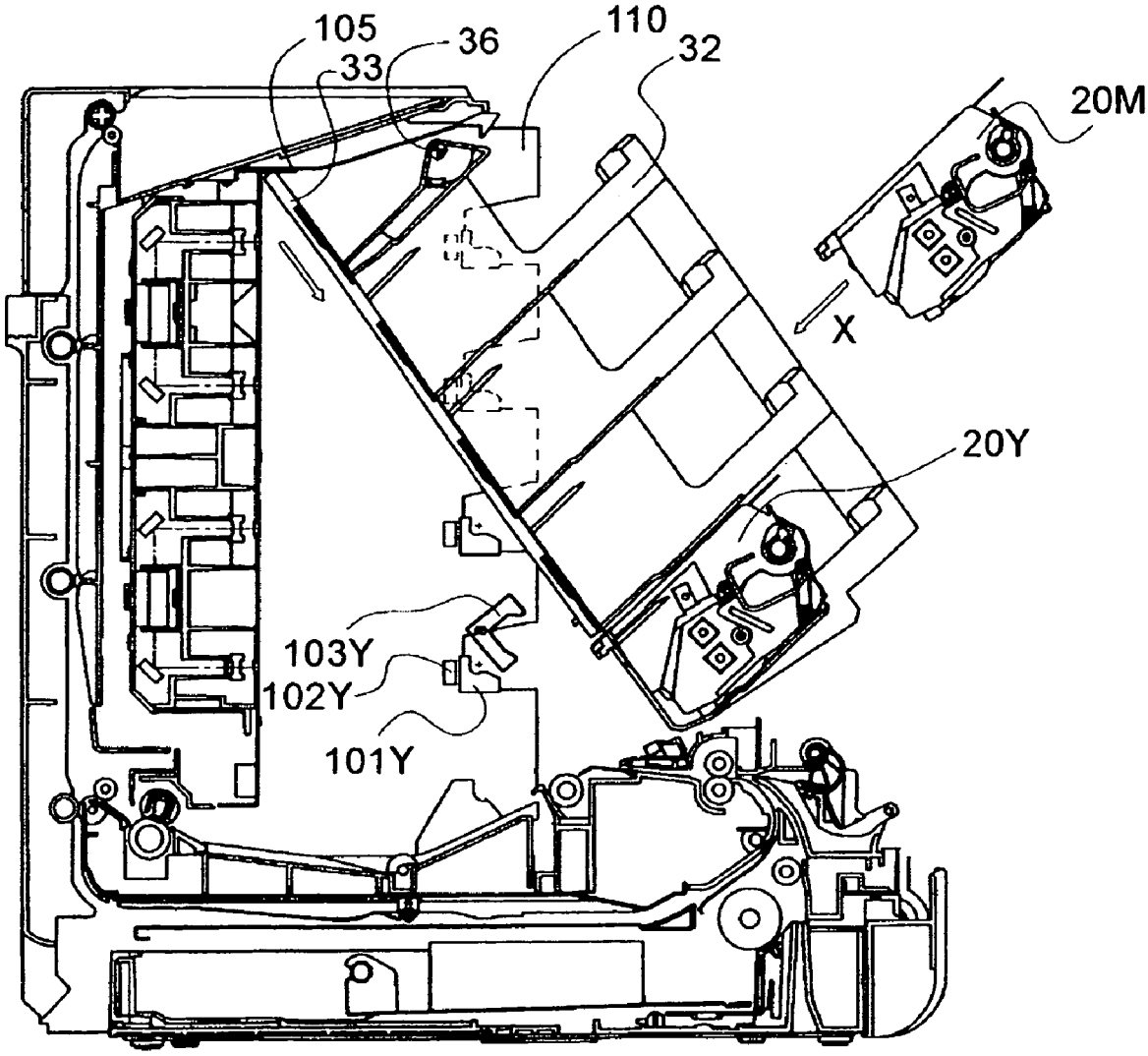
FIG. 9 is a schematic sectional view of the image forming apparatus in the first embodiment of the present invention, showing how a process cartridge in this embodiment is mounted into the main assembly of the image forming apparatus.
Figure 10:
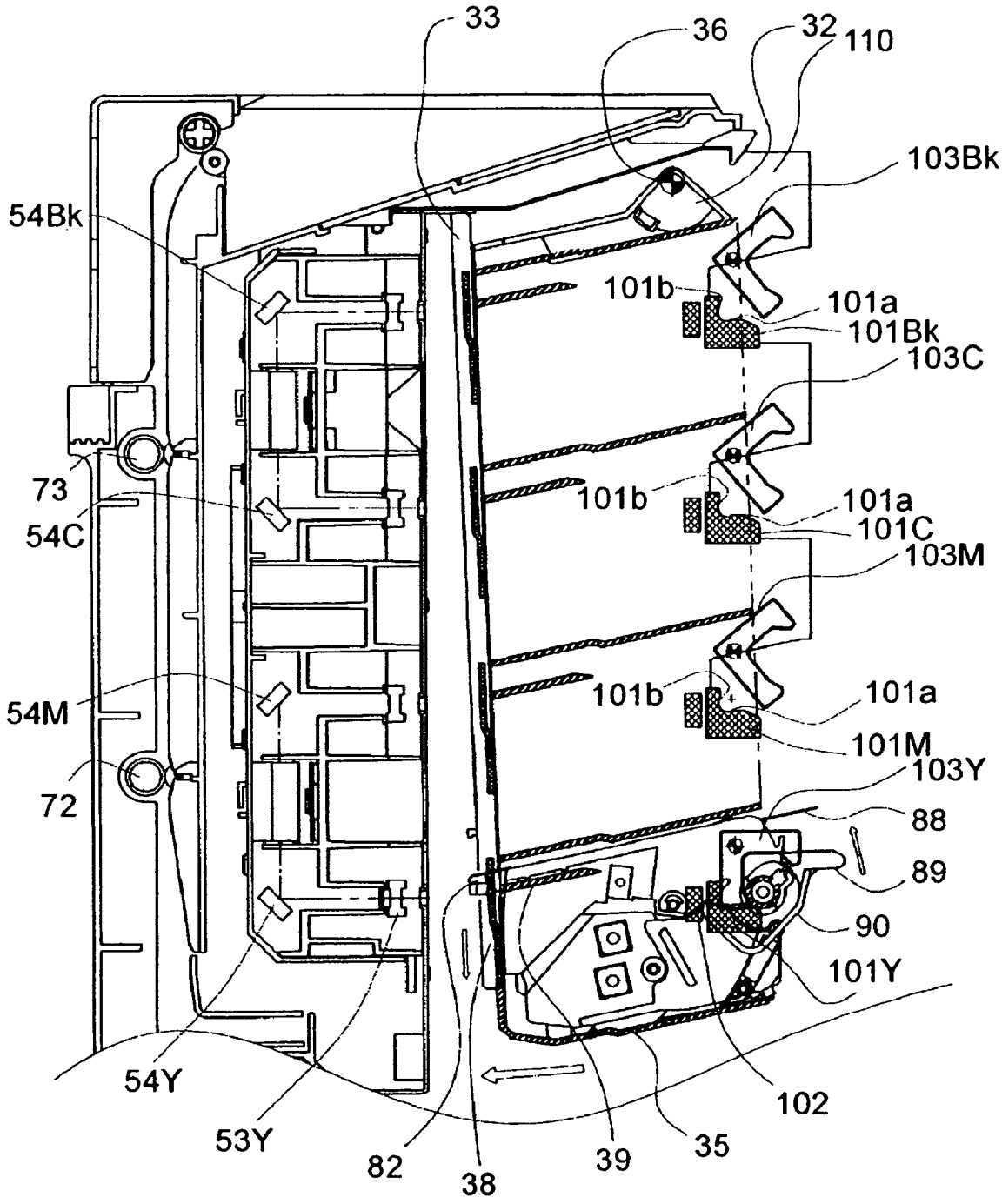
FIG. 10 is a schematic sectional view of the image forming apparatus in the first embodiment of the present invention, showing how the movable cartridge guide is pivoted.
Figure 11:
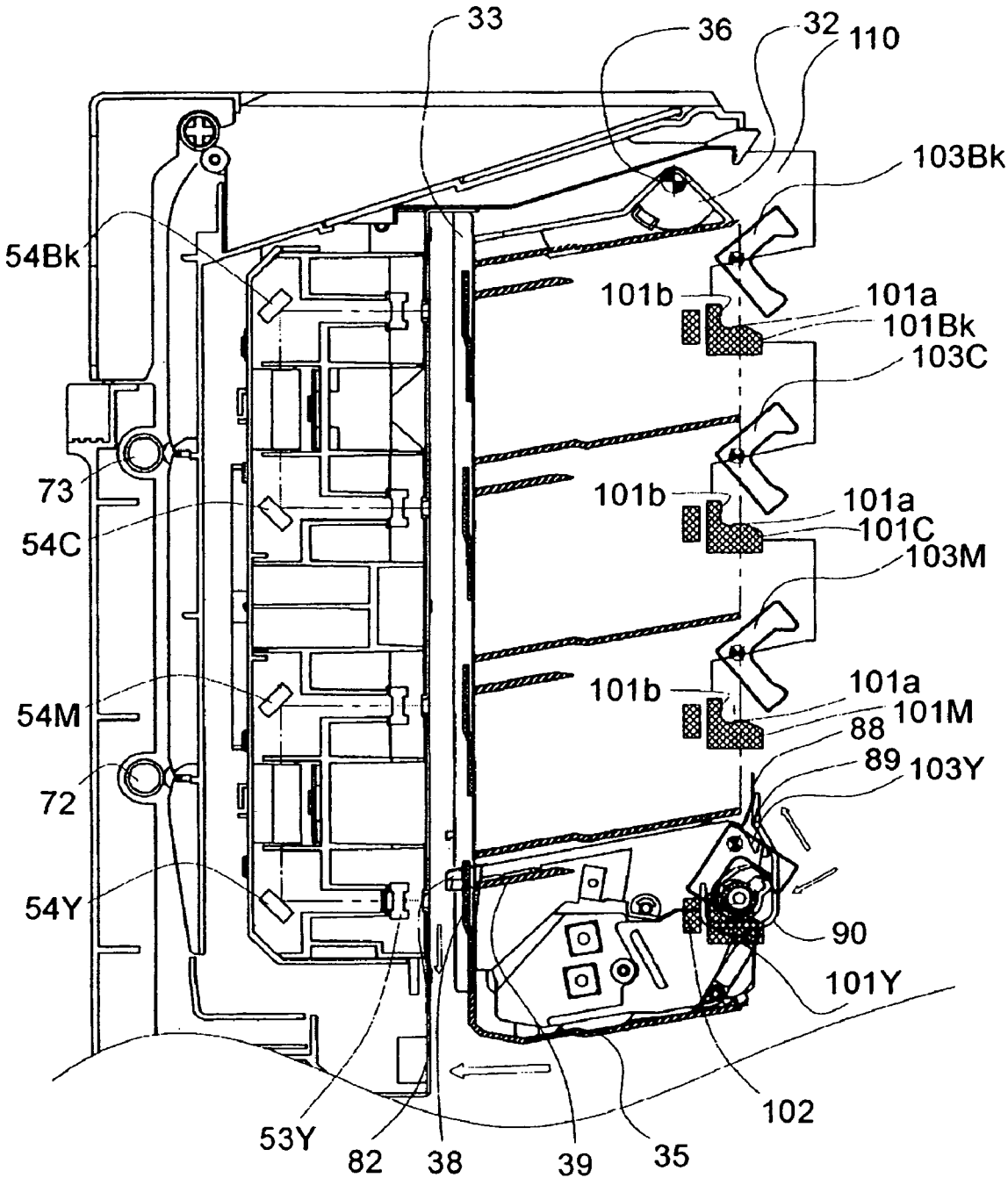
FIG. 11 is a schematic sectional view of the image forming apparatus in the first embodiment of the present invention, after the automatic mounting of the process cartridge into the main assembly of the image forming apparatus.

Next, referring to FIGS. 9, 10, and 11, the mechanism for moving the movable cartridge guide 3D, and the force which acts on the cartridges as the movable cartridge guide 30 is moved, will be described. FIG. 9 is a schematic sectional view of the image forming apparatus in this embodiment, showing how the cartridge 20 is mounted into the main assembly A of the image forming apparatus. FIG. 10 is a schematic sectional view of the essential portion of the image forming apparatus in this embodiment, showing how the movable cartridge guide is pivoted. FIG. 11 is a schematic sectional view at the essential portion of the image forming apparatus in this embodiment, after the automatic mounting of the cartridge into the main assembly A of the image forming apparatus.

FIGS. 9, 10, and 11 show the vertical section of the apparatus main assembly A, and left end of the cartridge 20. They show the movable cartridge guide on the left side of the apparatus main assembly A, that is, the movable cartridge guide 32, and also, the portions of the movable cartridge guide 32, which act on the cartridge 20. Further, they show only the portions of the side wall 110 of the apparatus main assembly A, which act on the cartridge 20, and the components, which are attached to the side wall 110, and act on the cartridge 20. When the image forming apparatus is in the state shown in FIG. 9, the movable cartridge guide 32 of the apparatus main assembly A is tilted at roughly 35°, and the mount 35 is tilted at roughly 10° relative to the movable cartridge guide 32 as described above. Thus, when the image forming apparatus is ready for cartridge insertion, the angle of the mount 35 relative to the horizontal plane is roughly 45°.

As a process cartridge for example, the magenta cartridge 20M shown in the drawing, is inserted in the direction indicated by an arrow murk, the cartridge 20 rests on the mounts 35 and 34 of the movable cartridge guides 30 and 32 by the parts of the bottom surface of the cartridge frame 26. Then, the cartridge 20 virtually automatically slides on the mounts 35 and 34, deeper into the movable cartridge guides 32 and 30. As for the sliding latch 33 slidably attached to the movable cartridge guide 32, it is kept pressured upward of the apparatus main assembly A by the resiliency of a spring (unshown). Therefore, the sliding latch 33 remains in contact with the top wall 105 of the apparatus main assembly A.

With the sliding latch 33 being in contact with the top wall 105, the latch extension 38 of the sliding latch 33 is kept in a position high enough not to interfere with the cartridge 20 while the cartridge 20 slides deeper into the movable cartridge guide 32 of the apparatus main assembly A.

Next, referring to FIG. 10, as the cover 10 is closed, the movable cartridge guide 32, which has been kept at roughly 35° relative to the vertical plane up to this point in the process, is rotated by the closing movement of the cover 10, until its angle relative to the vertical plane becomes roughly 5°, while forcing the sliding latch 33 to move downward along the movable cartridge guide 32. During this pivoting of the movable cartridge guide 32, and resultant downward movement of the sliding latch 33, the latch extension 38 of the sliding latch 33 engages with the left projection (catch) 82 of the cartridge 20.

The latch extension 38 is long enough to properly engage with the left projection (catch) 82 of the cartridge 20 while the sliding latch 33 is moved from the top end of its moving range to the bottom end. As the movable cartridge guide 32 of the apparatus main assembly A is pivoted the cartridge 20 therein is moved with the movable cartridge guide 32. Then, as the cartridge 20 approaches the cartridge positioning member 101 on the side wall of the apparatus main assembly A, three forces are generated which act in the direction to resist the inward movement of the cartridge 20.

The first of these three forces, which act in the direction to resist the inward movement of the cartridge 20, is the reactive force generated as the cartridge 20 is pressed directly against the cartridge positioning member 101. This force acts on the 20 cartridge retaining member 103. The second force is tile reactive force generated as the drum shutter rod 90 is rotated by the inward movement of the cartridge 20 after being made to contact the shutter moving member 102 disposed on the side wall of the apparatus main assembly A to open the drum shutter 89. The third force is the reactive force generated as the process cartridge 20 is made to slide on the upwardly slanted surface of the cartridge catching member on the side wall of the apparatus main assembly A.

Figure 12:
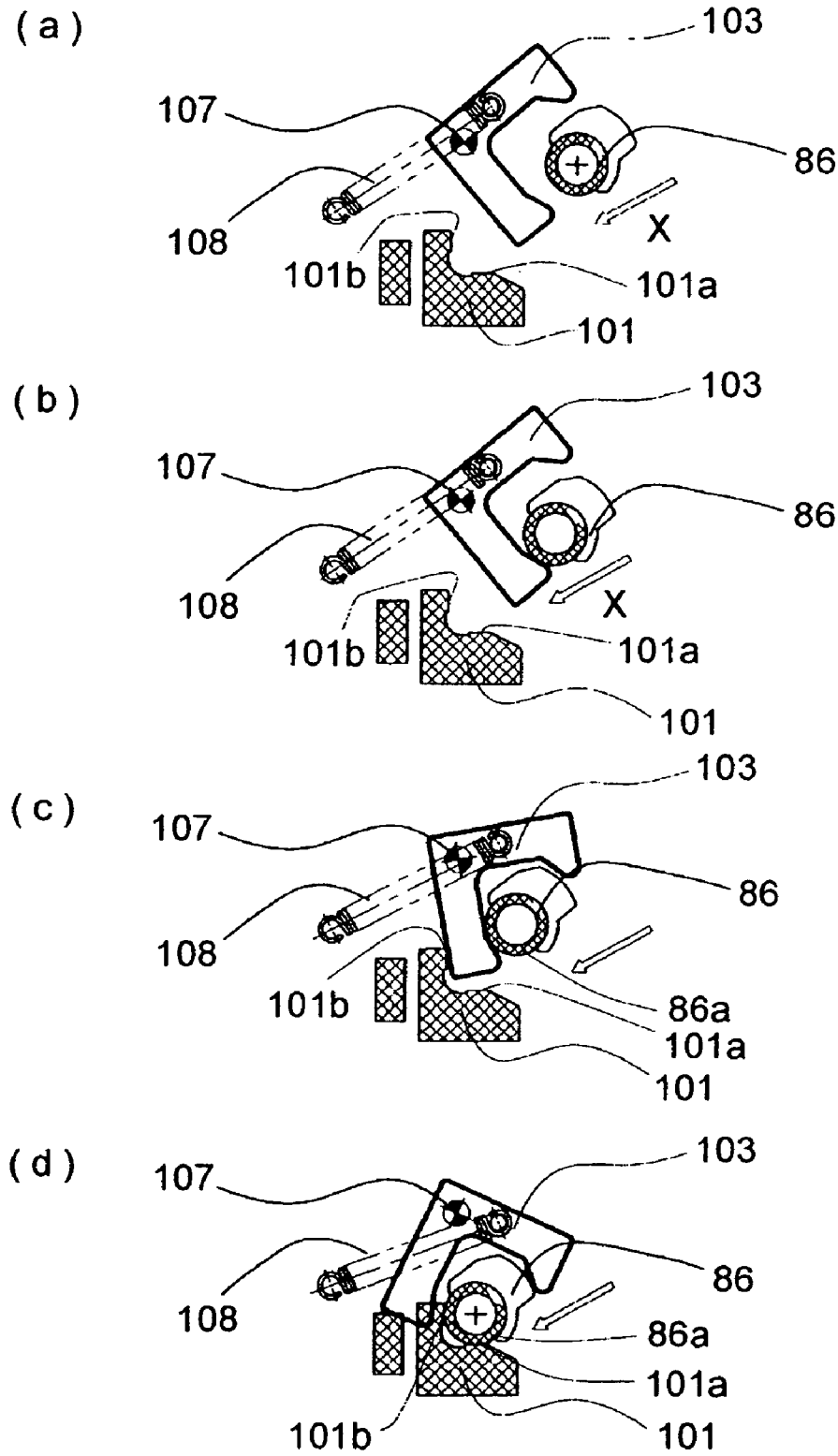
FIGS. 12(*a*), 12(*b*), 12(*c*) and 12(*d*) are a schematic side views of the cartridge retaining member, showing its movement.

Next, these three reactive forces will be described in detail. FIG. 12 is a schematic view of the cartridge retaining member 103 for keeping the cartridge 20 pressed on the cartridge Positioning member 101 of the apparatus main assembly A, showing sequentially the movements of the cartridge retaining member 103.

Referring to FIG. 12(*a*), the cartridge retaining member 103 (103Y, 103M. 103C, and 103Bk) is rotatably attached to the side wall 110 (FIG. 9) of the apparatus main assembly A. It is kept under the tension force generated by a tension spring 108 shown in the drawing. With the pivotal axis 107 of the cartridge retaining member 103 positioned as shown in the drawing, the tension spring 108 begins to be stretched as soon as the cartridge retaining member 103 begins to be pivoted. With the subsequent pivoting of the cartridge retaining member 103, the tension spring 108 is continuously stretched until the cartridge retaining member 103 is pivoted to a reversal point. Then, as the cartridge retaining member 103 is pivoted past this reversal point, the tension spring 108 is allowed to shrink, causing therefore the cartridge retaining member 103 to press the cartridge 20 so that the left positioning member 86 of the cartridge 20 will hit the cartridge positioning member 101 of the apparatus main assembly A, and be kept in contact therewith. The amount of the force generated by the spring 108 is in the range of roughly 500 gf (4.9 N)–1 kgf (9.8 N).

The cartridge retaining member 103 is pivoted by the cartridge 20 alone. More specifically, as the movable left cartridge guide 32 is pivoted, the left cartridge positioning member 86 approaches the cartridge retaining member 103, eventually contacting the cartridge retaining member 103. As soon as the left positioning member 86 contacts the cart ridge retaining member 103 (FIG. 12(*b*)), the tension spring 108 begins to be stretched, generating the reactive force which acts in the direction to push back the cartridge 20. As a result, an operator begins to feel resistance.

As the cartridge 20 is inserted deeper against the above-described reactive force generated by the tension spring 108 while stretching the tension spring 103, the cartridge retaining member 103 is pivoted beyond the aforementioned reversal point (FIG. 12(*c*)). As soon as the cartridge retaining member 103 is pivoted beyond the reversal point, the resilience of the spring 108 begins to act in the direction to press the left cartridge positioning member 86 directly on the cartridge positioning member 101 of the apparatus main assembly A, as shown in FIG. 12(*d*).

Thereafter, the cartridge positioning portion 86 of the cartridge 20 comes into contact with both the horizontal and vertical surfaces 101*a* and 101*b* of the cartridge positioning member 101 of the apparatus main assembly A, accurately positioning the cartridge 20 relative to the apparatus main assembly A.

More specifically, the bearing 86*a*, which is a part of the cartridge positioning portion 86, is made to hit the horizontal and vertical surfaces 101*a* and 101*b*. Incidentally, the bearing 86*a* is supporting the drum shaft 21*d* of the photosensitive drum 21.

Next, the drum shutter 89 will be described.

The photosensitive drum 21 in the cartridge 20 has a photosensitive layer, which reacts to light, contributing thereby to image formation. In other words, the photosensitive drum 21 is sensitive to light. Therefore, the cartridge 20 is provided with the drum shutter 89 (FIG. 7) in order to prevent the peripheral surface of the photosensitive drum 21 from being exposed to light while the cartridge 20 is out of the apparatus main assembly A. for example, during the shipment of the cartridge 20.

In this embodiment, a thin flexible sheet capable of blocking light is used as the material for the drum shutter 89. The drum shutter 89 is bonded to the cartridge frame 26 by one edge, and the opposite edge is attached to the drum shutter rod, around which the drum shutter 89 can be wound. The shutter rod is provided with a spring 93, which is attached to the right arm of the shutter rod and remains wound to generate force in the direction to rotate the shutter rod in the direction to close the drum shutter 89.

Referring to FIG. 9, while an operator inserts the cartridge 20 into the movable cartridge guide 32, the drum shutter 89 remains closed. Then, as the cartridge 20 is positioned close to the cartridge positioning member 101 of the apparatus main assembly A, as shown in FIG. 10, by the pivoting of the movable cartridge guide 32, the drum shutter rod 90 comes into contact with the shutter moving member 102 on the left side wall 110 of the apparatus main assembly A, beginning thereby to he rotated by the subsequent inward movement of the cartridge 20 resulting from the subsequent pivoting of the movable cartridge guide 32, while folding the flexible drum shutter 89 as shown in FIG. 10.

Next, referring to FIG. 11, as the cartridge 20 is locked into the predetermined position, the drum shutter 89 is completely folded, that is, completely retracted, upward by the drum shutter rod 90. During this process, the flexible cartridge handle 88 is bent upward by the drum shutter rod 90, generating thereby reactive force, which acts in the direction to push back the drum shutter rod 90. Thus, this reactive force from the flexible cartridge handle 88 pushes the shutter moving member 102 through the drum shutter rod 90, generating thereby reactive force which acts in the direction to push the drum shutter rod 90 in the direction opposite to the cartridge insertion direction. Consequently, the cartridge 20 receives such force that acts in the direction to move the cartridge 20 out of the movable cartridge guide 32. The amount of this force which acts in the direction to push the cartridge 20 out of the movable cartridge guide 32 is the sum of the resiliency of the shutter spring 93, resiliency of the flexible cart ridge handle 88, and resiliency of the drum shutter 89, and is in the range of roughly 1 N (100 gf)–3 N (300 gf).

Next, the reactive force generated as the cartridge 20 is forced to slide on the upwardly slanted surface of the cartridge catching member (cartridge positioning member) on the side wall of the apparatus main assembly will be described.

This reactive force is generated immediately before the cartridge 20, which temporarily rests on the mount 35 of the movable cartridge guide 32, is moved into the normal position, that is, the predetermined image formation position, in the apparatus main assembly A. The amount of this reactive force is determined by the weight of the cartridge 20 itself, and the distance by which the cartridge 20 is vertically moved as it is made to climb onto the horizontal surface 101*a* of the cartridge catching portion (cartridge positioning portion. As the cartridge 20, which weighs roughly 1 kg, is pushed up along the surface, tilted upward at 45°, of the cartridge catching member (cartridge positioning member), its own weight generates force which acts on the cartridge 20 in the direction to push the cartridge 20 out of the movable cartridge guide 32.

As described above, while the process cartridge is mounted into the main assembly A of the image forming apparatus with the use of the automatic mounting system, the above described various reactive forces act on the cartridge 20 as the movable cartridge guides 30 and 32 are pivotally moved.

In this embodiment, the movable cartridge guides 30 and 32 are provided with the sliding latches 31 and 33, respectively, which are slidable along the movable cartridge guides 30 and 32, respectively. The sliding latches 31 and 33 are slid by the opening or closing movement of the cover 10. More specifically, as the movable cartridge guides 30 and 32 begin to be moved by the opening movement of the cover 10, first, the latch extensions 37 and 38 of the sliding latches 31 and 33 engage with the projections (catches) 81 and 82 of the cartridge 20. Then, the reactive force generated by the cartridge remaining member 103 begins to act on the process cartridge 20, and the, the reactive force generated as the drum shutter 89 is opened, acts on the process cartridge 20. Lastly, the reactive force generated as the cartridge 20 is pushed along the upwardly tilted surface of the cartridge positioning member acts on the cartridge 20.

However, the cartridge 20 is guided to the cartridge catching surface 101*a* and 101*b* of the cartridge positioning member 101, by the movable cartridge guides 30 and 32, while the above-described reactive forces are absorbed by the latch extensions 37 and 38. Thus, as the cartridge 20 comes into contact with the cartridge catching surfaces 101*a* and 101*b*, the latch extensions 37 and 38 disengage from the projections (catches) 81 and 82.

The aforementioned cartridge retaining member 103 continuously generates the reactive force until it is rotated to the position shown in FIG. 12(*c*). However, as soon as the cartridge retaining member 103 is rotated past the position shown in FIG. 12(*e*), it begins to press on the positioning portion 86 of the cartridge 20 inward of the movable cartridge guide. As a result, the positioning portion 86 is slid on the horizontal surface 101*a* of the positioning member 101, by the cartridge retaining member 103, until it hits the vertical surface 101*b* of the cartridge retaining member 103. As the cartridge 20 is slid on the horizontal surface 101*a*, the latch extensions 37 and 38 are disengaged from the projections (catches) 81 and 82, respectively.

Thereafter, the cover 10 is to be closed, and as the cover 10 is closed, the cartridge 20 is automatically and accurately moved into the image formation position 300 for the cartridge 20, in the apparatus main assembly A.

As described above, while the cartridge 20 is moved into the image formation position 300 in the apparatus main assembly A, it is retained by the latch extensions 37 and 38. Therefore, it is assured that the cartridge 20 is moved into the image formation position 300 in spite of the presence of the above-described reactive forces which act on the cartridge 20.

Here, the image formation position 300 means the final position into which the cartridge 20 is moved for image formation, in the apparatus main assembly A. The position of the cartridge 20 while driving force is transmitted to the cartridge 20 from the apparatus main assembly A is slightly different from that while driving force is not transmitted to the cartridge 20. In this specification, however, both of these cartridge positions are treated as the image formation position.

Embodiment 2

Next, referring to FIGS. 4 and 13-18, the process cartridge and image forming apparatus in the second embodiment of the present invention will be described. The structures of the process cartridge and image forming apparatus similar to those in the first embodiment will not be described, and only those which characterize this embodiment will be described in detail.

Figure 15:
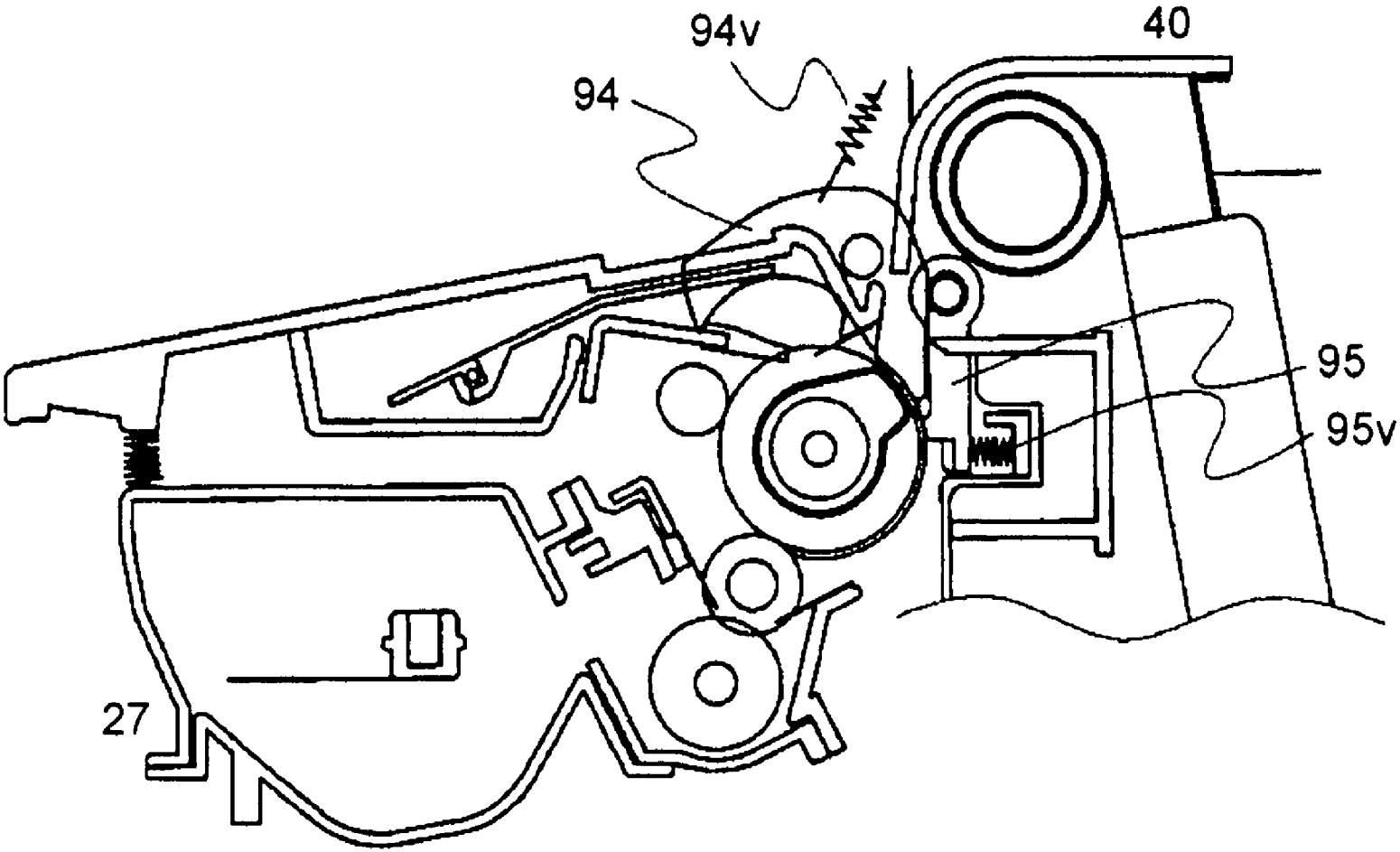
FIG. 15 is a schematic sectional view of one of the process cartridges, the cartridge retaining member therefor, and their adjacencies, in the image forming apparatus in the second embodiment of the present invention, showing the positioning of the cartridge retaining member.
Figure 16:
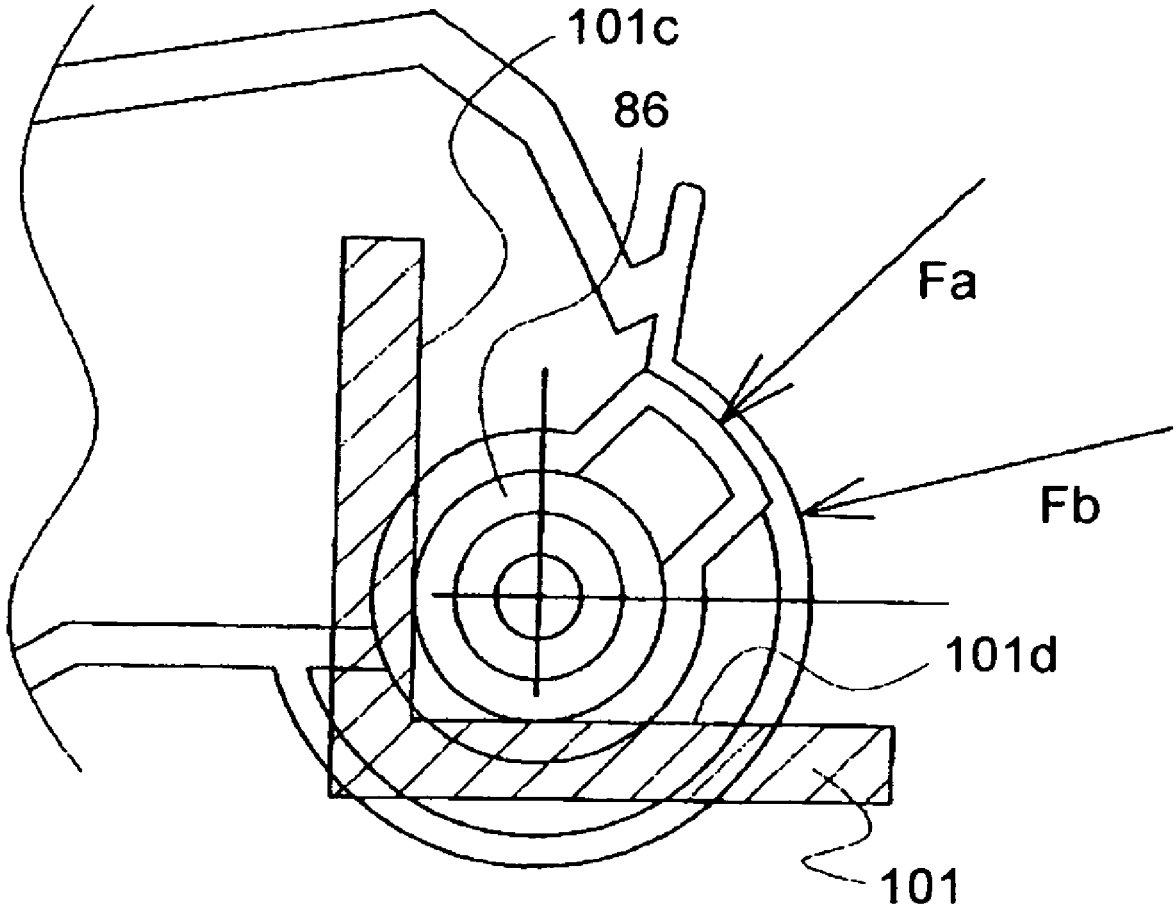
FIG. 16 is a schematic sectional view of the cartridge positioning portion of the process cartridge in the second embodiment of the present invention, showing how the cartridge positioning portion is accurately positioned.
Figure 17:
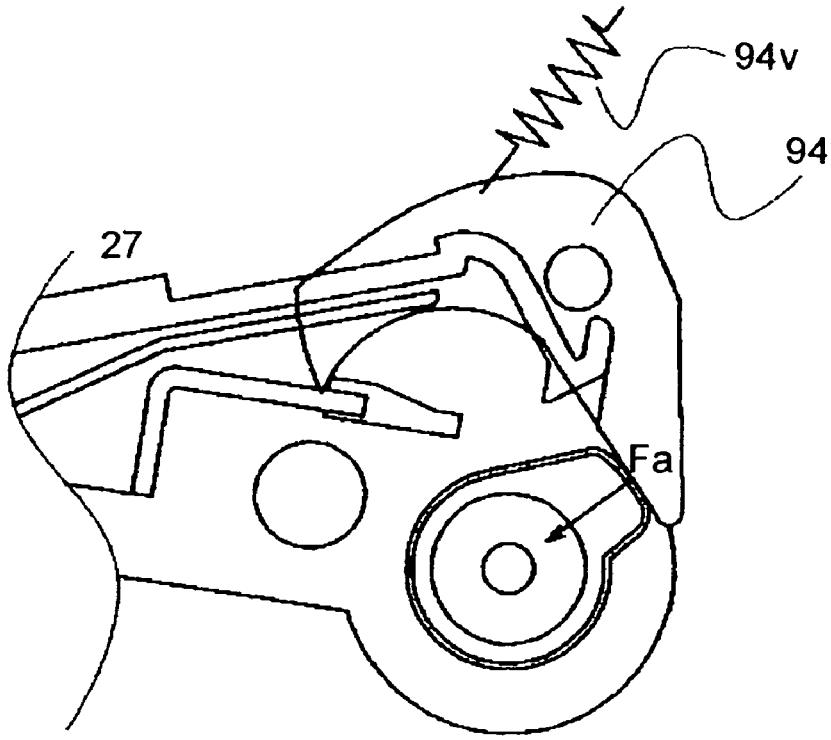
FIG. 17 is a schematic sectional view of an urging member according to the second embodiment.
Figure 18:
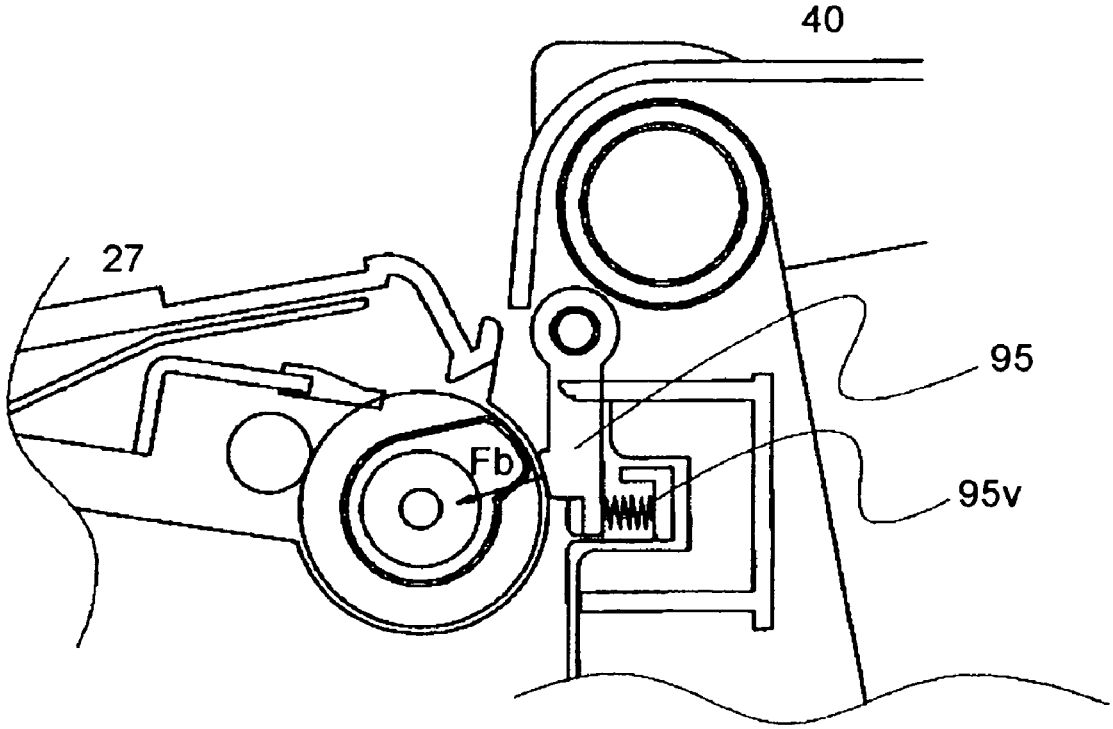
FIG. 18 is a schematic sectional view of an urging member according to the second embodiment.

FIG. 15 is a sectional view of the cartridge retaining member and its adjacencies in this embodiment showing the positioning thereof. FIGS. 16. 17, and 18 are schematic sectional views of the cartridge retaining member in this embodiment.

Referring to FIG. 15, the reactive forces which act on the cartridge 20 are generated by the first cartridge retaining member 94 (94*a*, 94*b*. 94*c*, and 94*d*) on the side walls 100 and no of the apparatus main assembly A, and second cartridge retaining member 95 (95*a*, 95*b*, 95*c*, and 95*d*) on the intermediary transfer member 40 integral with the cover 10. Referring to FIG. 16, the cartridge 20 is pressed by the first cartridge retaining member 94 in the first direction (diagonally downward at roughly 45° relative to horizontal plane), and also is pressed by the second cartridge retaining member 95 in the second direction (diagonally downward at roughly 15° relative to horizontal plane). In addition, the cartridge 20 is pressed by the resiliency of springs (unshown) in the direction to cause the positioning members 85 and 86 of the cartridge 20, which also are bearings, to be pressed against the two surfaces, that is, the rear and bottom surfaces 101*c* and 101*d*, of each the cartridge positioning members 101 on the side walls 100 and 110 of the apparatus main assembly A. As a result, the cartridge 20 is accurately positioned relative to the apparatus main assembly A.

In this embodiment, the role of positioning the cartridge 20 relative to the apparatus main assembly A is carried out by the apparatus main assembly A independently from the movable cartridge guides 30 and 32.

Figure 13:
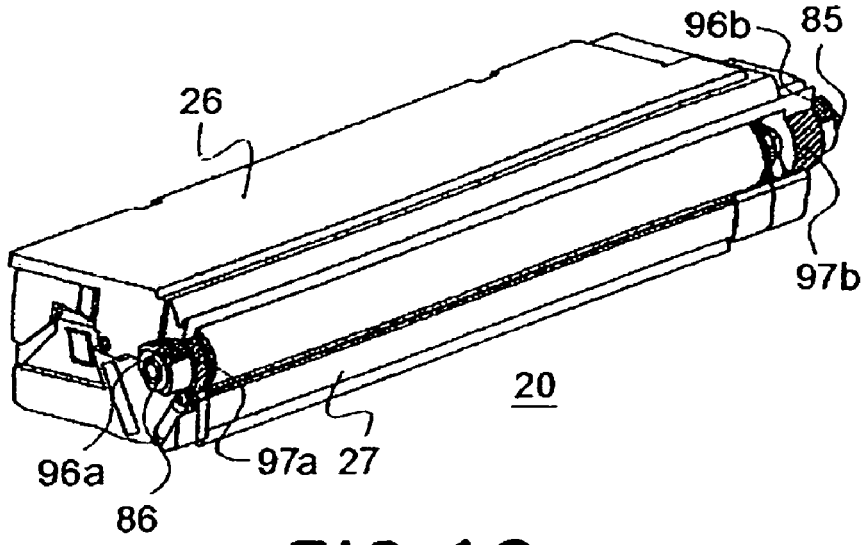
FIG. 13 is a schematic external perspective view of the process cartridge in a second embodiment of the present invention.
Figure 14:
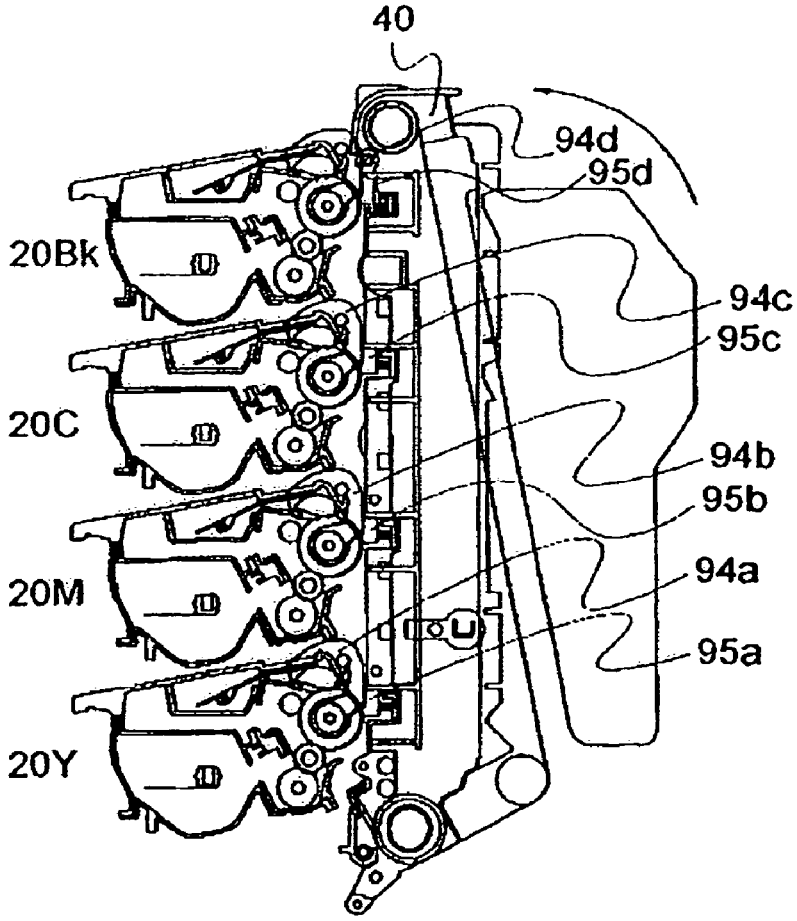
FIG. 14 is a schematic sectional view of an essential portion of the image forming apparatus in the second embodiment of the present invention, showing the positioning of the cartridge retaining members.

FIG. 13 is an external perspective view of the cartridge 20 in this embodiment. As shown in FIG. 13, the portions of the cartridge 20, by which the cartridge 20 is pressed. are first contact portion 96 (96*a* and 96*b*) and second contact portion 97 (97*a* and 97*b*) located at the lengthwise ends of the cartridge frame 26, one for one. These contact portions are pressed by the above described first and second cartridge retaining members 94 and 95, respectively. Further, the contact portions do not need to he parts of the cleaning frame of the cartridge frame 26. For example, they may be components attachable to the cleaning frame, or the positioning portions 85 and 86, which also are bearings with which the development frame 27 is provided.

Immediately before the cover 10 is completely closed, the cartridge 20 receives the pressure generated by the second cartridge retaining member 95 attached to the intermediary transfer member 40 integral with the cover 10, in the direction to press the cartridge 20 toward the cartridge positioning member. More specifically, when the positioning portions 85 and 86 ride onto the first cartridge retaining member 94, the cartridge 20 receives the reactive force which acts in the direction opposite to the cartridge insertion direction. In this embodiment, however, the two cartridge retaining members are used to press the cartridge 20 in steps. Therefore, when mounting the cartridge 20, the reactive forces generated by the cartridge retaining members in the direction to push the cartridge 20 out or the apparatus main assembly A are relatively small, allowing the cartridge 20 to be smoothly mounted into the apparatus main assembly A.

[Forces which Act on Process Cartridge after Mounting of Process Cartridge into Image Forming Apparatus]

As the cover 10 is closed, as shown in FIG. 16, after the complete insertion of the cartridge 20 into the movable cartridge guides, the cartridge frame 26 is subjected to a force Fa generated by the first cartridge retaining member 94 in the diagonally downward direction, more specifically, at roughly 45° relative to the horizontal plane, and a force Fb generated by the second cartridge retaining member 95 in the diagonally downward direction, more specifically, at roughly 15° relative to the horizontal plane. Further, the photosensitive drum 21 is subjected, through intermediary transfer member 40, to a force Fc (unshown) generated by the primary transfer roller 42 in the direction to keep the cartridge 20 properly positioned relative to the apparatus main assembly A, that is, in the direction virtually parallel to the bottom wall of the apparatus main assembly A. In other words, the cartridge 20 is kept accurately positioned relative to the cartridge positioning member 101 of the apparatus main assembly A, by being subjected to the forces Fa, Fb, and Fe.

On the other hand, as driving force is transmitted to the cartridge 20 during image formation, the cartridge 20 is subjected to a force Fd (reactive force) generated by the transmission of the driving force in the direction opposite to the cartridge mounting direction. The direction in which the force Fd is generated is determined by the position of the output gear (unshown) of the mechanical power source of the apparatus main assembly A, the position of the input gear (unshown) of the cartridge 20 and the operating pressure angles of the two gears.

Here, the forces which horizontally act are designated by reference symbols Fa1, Fb1, Fc1, and Fd1, and the forces which vertically act are designated by reference symbols FaZ, Fb2, FeZ, and Fd2. All that is necessary to assure that the cartridge is kept properly positioned is Lo satisfy the following inequality: Fa1+Fh1+Fb1+Fc1>Fd1 (in terms of direction parallel to bottom wall of apparatus main assembly A). In terms of vertical direction (direction virtually perpendicular to bottom wall of apparatus main assembly A), there is nothing to be concerned about, because the forces Fa2, FbZ, Fe2, and Fd2 act in the Same direction. that is, vertically downward, and therefore, the inequality: Fa2+Fb2+Pc2+Fd>0 is always satisfied.

The description of this embodiment given above can be summarized as follows:

The process cartridge 20 which is mounted in the movable cartridge guides 30 and 32 of the main assembly A of the electrophotographic image forming apparatus (printer), and then, is moved by the movement of the movable cartridge guides 30 and 32 from the cartridge mounting position 300 to the image formation position 300, includes:

the electrophotographic photosensitive drum 21;

the processing means (for example, charge roller 22, development roller 23, and cleaning blade 24) which act on the electrophotographic photosensitive drum 21;

the cartridge frame 26 which supports the electrophotographic photosensitive drum 21 and processing means;

the first contact areas 26*a* and 30*b*, by which the cartridge 20 is supported by the movable cartridge guide 30, and which are located at one of the lengthwise ends of the photosensitive drum 21;

the second contact areas 26*b*, 26*c*, 27*a*, and 27*b*, by which the cartridge is supported by the movable cartridge guide 32, and which are located at the other lengthwise end of the photosensitive drum 21;

the first cartridge positioning portion 85, which is extended from one of the lengthwise ends of the cartridge 20 in the direction parallel to the axial line of the photosensitive drum 21, to be placed in contact with the main assembly A of the image forming apparatus in order to properly position the cartridge 20 relative to the apparatus main assembly A, and the axial line of which coincides with that of the photosensitive drum 21;

the second cartridge positioning portion 86, which is extended from the other lengthwise end of the cartridge 20 in the direction parallel to the axial line of the photosensitive drum 21, to be placed in contact with the main assembly A of the image forming apparatus in order to properly position the cartridge 20 relative to the apparatus main assembly A, and the axial line of which coincides with that of the photosensitive drum 21; and the projections (as catches) 81 and 82 which engage with the latches (sliding latches 31 and 33) movable by the movement of the movable cartridge guides 30 and 32, and absorb the reactive force generated as the cartridge 20 is moved from the cartridge mounting position 200 to the image formation position 300.

With the provision of the above described structural arrangement, while the cartridge is moved from the cartridge mounting position 200 to the image formation position 300, it is kept under the reactive force generated by the structural arrangement, being thereby prevented from substantially dislodging from the movable cartridge guides 30 and 32. Therefore, it is assured that the cartridge 20 is easily moved to the image formation position 300.

The cartridge mounting position 200, by the way, is the position at which the cartridge 20 is mounted into the movable cartridge guides 30 and 32. The cartridge mounting position 200 is located on the cover 10 side of the movable cartridge guides 30 and 32, making it therefore easier for an operator to insert the cartridge 20 into the movable cartridge guides 30 and 32, or to move the cartridge 20 therefrom.

The projections (catches) 81 and 82 of the cartridge 20 are located at the leading end of the cartridge frame 26 in terms of the cartridge mounting direction (X direction).

According to this structural arrangement, the projections (catches) 81 and 82 are located a predetermined distance away from the leading end of 20 the cartridge frame 26, in the cartridge mounting direction, assuring that the cartridge 20 will be temporarily held to the movable cartridge guides 30 and 32 by the latches (sliding latches 31 and 33) provided on the main assembly side A of the image forming apparatus. Therefore, it is assured that the cartridge 20 will be moved to the position 300 in which the cartridge 20 is used for image formation.

Also according to this structural arrangement, not only are the projections (catches) 81 and B2 located a predetermined distance away from the leading end of the cartridge frame 26, in the cartridge mounting direction, but also are located a predetermined distance away, leftward and rightward, one for one, from the center of the photosensitive drum 21, in the lengthwise direction of the photosensitive drum 21.

In other words, in terms of the lengthwise direction of the photosensitive drum 21, the projection (catch) 81 is located the predetermined distance leftward of the center of the photosensitive drum 21 (center of leading edge of cartridge frame 26), and the projection (catch) 82 is located the predetermined distance rightward of the center of the photosensitive drum 21 (center of leading edge of cartridge frame 26).

With the provision of this structural arrangement in which not only are the projections (catches) 81 and 82 located a predetermined distance away from the leading end of the cartridge frame 26, in the cartridge mounting direction (X direction), but also arc located a predetermined distance away, leftward and rightward one for one, of the center of the photosensitive drum 21, in the lengthwise direction of the photosensitive drum 21, the cartridge 20 can be temporarily held, by two locations thereof, to the movable cartridge guides 30 and 32 by the latches (sliding latches 31 and 33) provided on the main assembly side A. Therefore, the cartridge 20, which is to be mounted into the apparatus main assembly A in the widthwise direction of the cartridge 20, can be more easily and securely mounted into the apparatus main assembly A.

Here. "widthwise direction" means the direction intersecting with the lengthwise direction of the photosensitive drum.

Further, the catch portions 81 and 82 includes the first projecting portions 83 and 84, and second projecting portions 81 and 82, respectively. The first projecting portions 83 and 84 project from the cartridge frame 26 in the cartridge mounting direction (X direction), in the direction roughly perpendicular to the lengthwise direction of the photosensitive drum 21. The second projecting portions 81 and 82 project from the first projecting portions 83 and 84. Respectively, in the direction roughly parallel to the lengthwise direction of the photosensitive drum 21.

According to this structural arrangement, the recesses (voids) of the catch portions 81 and 82, into which the sliding latches 31 and 33 fit, are in the shape of a key extending in the lengthwise direction, making thereby the catch portions 81 and 82 stronger. It is assured that the cartridge 20 will automatically and properly mounted into the main assembly A of the image forming apparatus.

Further, the first cartridge positioning portion 85 and/or second cartridge positioning portion 86 are pressed toward, and kept pressed upon, the cartridge positioning members 101 of the main assembly A of the image forming apparatus, by the first cartridge retaining member 94 of the apparatus main assembly A for pressing the positioning portion 85 and/or second cartridge positioning portion 86 in the first direction, and the second cartridge retaining member 95 of the main assembly A for pressing the first cartridge positioning portion 85 and/or second cartridge positioning portion 86 in the second direction respectively.

With the provision of this structural arrangement, the cartridge positioning portions are pressed from two different directions. Therefore, not only is the cartridge more reliably and accurately positioned, but also the amount, of the pressure which the cartridge receives from each member is smaller. Therefore, the reactive forces, for example, the reactive force generated by the friction, which the cartridge receives while the cartridge is moved from the mounting position to the image formation position, are smaller in magnitude. Therefore, it is further assured, that the cartridge will be automatically and properly mounted into the main assembly A of the image forming apparatus.

Further, the first cartridge positioning portion 85 and/or second cartridge positioning portion 86 are pressed toward and kept pressed upon, the cartridge positioning members 101 of the image forming apparatus by the first cartridge retaining member 94 attached to the frame (side walls 100 and 110) of the main assembly A of the image forming apparatus in order to press the first cartridge positioning portion 85. and/or second cartridge positioning portion 86 in the first direction, and the second cartridge retaining member 95 attached to the transfer unit (intermediary transfer member 40) on the main assembly A side of the image forming apparatus in order to press the first cartridge positioning portion 85 and/or second cartridge positioning portion 86 in the second direction, which is different from the first direction.

Further, the latches (sliding latches 31 and 33) are attached to the movable cartridge guides 30 and 32 so that they are engaged with the catches, one for one, by the movement of the movable cartridge guides 30 and 32.

With the provision of this structural arrangement, as the cover 10 is opened, the latches (sliding latches 31 and 33) are slid upward by the opening movement of the cover 10. Therefore, when the cartridge 20 is mounted into the movable cartridge guides 30 and 32, the latches (sliding latches 31 and 33) do not interfere with the catch portions 81 and 82 of the cartridge 20, allowing the cartridge 20 to be inserted deeper into the movable cartridge guides 30 and 32 in the cartridge mounting direction (X direction), further assuring the successful automatic mounting of the cartridge 20.

Further, the movable cartridge guides 30 and 32 are attached to the main assembly A of the image forming apparatus so that they are pivotally moved relative to the main assembly A by the opening or closing movement of the cover 10 of the apparatus main assembly A.

With the provision of this structural arrangement, when automatically mounting the process cartridge 20 into the apparatus main assembly A, as the cover 10 is closed, the cartridge 10 is moved into the apparatus main assembly A while being continuously pulled toward the cartridge positioning portions 101, 101*a*, and 101*b*, further assuring that when the cartridge 20 is automatically mounted into the apparatus main assembly A of the image forming apparatus, it is properly positioned relative to the apparatus main assembly A.

Further, each of the latches (sliding latches 31 and 33) has three portions, that is, a leading end portion, a mid portion (guiding portions 37*c* and 38*a*), and a trailing portion, in terms of latching direction, making the distance between the leading position and the catch portion 81 (82) different from the distance between the trailing portion and the catch portion 81 (82). Thus, at the beginning of the engagement of the latch with the catch portion 81 (82) of the cartridge 20, the catch portion 81 (82) is not pulled toward the latch 31 (33). Then, as the movable cartridge guides 30 and 32 are further pivoted inward of the apparatus main assembly A, the catch portion 81 (82) begins to be gradually pulled toward the latch 31 (33).

With the provision of this structural arrangement, in which each of the latches (sliding latches 31 and 33 has three portions, that is, leading end portion, mid portion (guiding portions 37C and 38*a*), and trailing portion, in terms of latching direction, making the distance between the leading portion and the catch portion 81 (82) different from the distance between the trailing portion and the catch portion 81 (82), the cartridge 20 is not pulled by the latch 31 (33) at the beginning of the engagement of the latch 31 (33) with the catch portion 81 (82). Then, as the movable cartridge guides 30 and 32 are further pivoted inward of the apparatus main assembly A, the cartridge 20 is gradually pulled toward the latch 31 (33). In other words, when mounting the cartridge 20 into the movable cartridge guides 30 and 32, the cartridge 20 does not reach the inward ends of the movable cartridge guides 30 and 32, remaining therefore slightly outward of the final position, that is, the image formation position. However, as the cover 10 begins to be closed, the movable cartridge guides 30 and 32 begins to be pivoted inward of the apparatus main assembly A by the closing movement of the cover 10, causing thereby the latches (sliding latches 31 and 33) to begin to slide and engage with the catches 81 and 82. Thereafter, as the cover 10 is further closed, the force is generated by the combination of the latches 31 and 33 and the catch portions 81 and 82, in the direction to pull the c:artridge 20 inward of the movable cartridge guides 30 and 32. Therefore, it is further assured that the cartridge 20 is automatically and accurately mounted.

As described above, according to the present invention, a process cartridge can be improved in its operability in terms of the mounting of the process cartridge into the main assembly of an electrophotographic image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge which is capable of being carried on a movable guide provided in the main assembly of an electrophotographic image forming apparatus and which is movable from a receiving position toward a mount position in interrelation with movement of the movable guide, comprising:

an electrophotographic photosensitive drum;

process means actable on said electrophotographic photosensitive drum;

a cartridge frame supporting said electrophotographic photosensitive drum and said process means;

a first portion to be carried, provided at one longitudinal end of said photosensitive drum, configured and positioned to be supported by the movable guide at the receiving position;

a second portion to be carried, provided at the other longitudinal end of said photosensitive drum, configured and positioned to be supported by the movable guide at the receiving position;

a first positioning portion to be positioned relative to a main assembly of the image forming apparatus, at the mount position, said first positioning portion extending outwardly from said cartridge frame adjacent the one longitudinal end of said photosensitive drum;

a second positioning portion to be positioned relative to the main assembly of the image forming apparatus at the mount position, said second positioning portion extending outwardly from said cartridge frame adjacent the other longitudinal end of said photosensitive drum; and an engaging portion provided at a leading end with respect to a direction from the receiving position to the mount position, for engagement with a locking portion which is provided in the main assembly of the image forming apparatus and which is movable in interrelation with the movement of said movable guide, said engaging portion receiving a pulling force in the direction from the receiving position toward the mount position by movement of the locking portion in interrelation with the movement of the movable guide while being in engagement with said engaging portion.

2. A process cartridge according to claim 1, wherein said engaging portion is projected from said cartridge frame in a mounting direction in which said process cartridge is mounted in the image forming apparatus and is provided at each of lateral sides of said cartridge frame substantially at a longitudinally central position of an axis of said photosensitive drum.

3. A process cartridge according to claim 1 or 2, wherein said engaging portion includes a first projected portion projected substantially perpendicularly to the longitudinal direction of said photosensitive drum from said cartridge frame toward a mounting direction in which said process cartridge is mounted in the image forming apparatus, and a second projected portion projected from the first projected portion substantially parallel with respect to the longitudinal direction of said photosensitive drum.

4. A process cartridge according to claim 1 or 2, wherein said first positioning portion and/or said second positioning portion is urged to a positioning member provided in the main assembly of the image forming apparatus by a first urging member, provided in the main assembly of the image forming apparatus, configured and positioned to urge said first positioning portion and/or said second positioning portion in a first urging direction and a second urging member configured and positioned to urge said first positioning portion and/or said second positioning portion in a second urging direction which is different from the first urging direction.

5. An electrophotographic image forming apparatus for forming an image on a recording material, wherein a process cartridge is detachably mountable to said electrophotographic image forming apparatus, said electrophotographic image forming apparatus comprising:

(i) a movable guide;

(ii) a locking portion; and (iii) a mounting portion configured and positioned to detachably mounted the process cartridge, which includes:

an electrophotographic photosensitive drum;

process means actable on the electrophotographic photosensitive drum;

a cartridge frame supporting the electrophotographic photosensitive drum and the process means;

a first portion to be carried, provided at one longitudinal end of the photosensitive drum, configured and positioned to be supported by said movable guide at a receiving position;

a second portion to be carried, provided at the other longitudinal end of the photosensitive drum, configured and positioned to be supported by said movable guide at the receiving position;

a first positioning portion to be positioned relative to the main assembly of said image forming apparatus at the mount position, the first positioning portion extending outwardly from the cartridge frame adjacent the one longitudinal end of said photosensitive drum;

a second positioning portion to be positioned relative to the main assembly of said image forming apparatus at the mount position, the second positioning portion extending outwardly from the cartridge frame adjacent the other longitudinal end of the photosensitive drum; and an engaging portion, provided at a leading end with respect to a direction from the receiving position to the mount position, configured and positioned to engage with the locking portion which is movable in interrelation with the movement of said movable guide, the engaging portion receiving a pulling force in the direction from the receiving position toward the mount position by movement of the locking portion in interrelation with the movement of said movable guide while being in engagement with the engaging portion.

6. An apparatus according to claim 5, wherein said movable guide is capable of guiding a plurality of process cartridges from the receiving position to the mount position, wherein said locking portion is engageable with a plurality of engaging portions provided in the plurality of process cartridges and produces forces for pulling the process cartridges from the receiving position to the mount position.

7. An apparatus according to claim 5 or 6, wherein said locking portion is slidable relative to said movable guide in interrelation with movement of said movable guide.

8. An apparatus according to claim 5 or 6, wherein said movable guide is swingable relative to said image forming apparatus in interrelation with an opening and closing operation of an openable member provided in said image forming apparatus.

9. An apparatus according to claim 8, wherein said locking portion has a stepped portion which provides portions remote from the engaging portion at different distances, wherein at the start of engagement with the engaging portion of the process cartridge, the pulling force is not applied, and the pulling force is supplied with the swinging of said movable guide.

10. A process cartridge mounting mechanism for mounting a process cartridge to a main assembly of an electrophotographic image forming apparatus, wherein the main assembly of the electrophotographic image forming apparatus comprises a movable guide and a locking portion, wherein the process cartridge comprises an electrophotographic photosensitive drum, process means actable on the electrophotographic photosensitive drum, a cartridge frame supporting the electrophotographic photosensitive drum and the process means, a first portion to be carried, provided at one longitudinal end of the photosensitive drum, configured and positioned to be supported by the movable guide at a receiving position, a second portion to be carried, provided at the other longitudinal end of the photosensitive drum, configured and positioned to be supported by the movable guide at the receiving position, a first positioning portion to be positioned relative to the main assembly of the image forming apparatus at the mount position, the first positioning portion extending outwardly from the cartridge frame adjacent the one longitudinal end of the photosensitive drum, a second positioning portion to be positioned relative to the main assembly of the image forming apparatus at the mount position, the second positioning portion extending outwardly from the cartridge frame adjacent the other longitudinal end of the photosensitive drum, and an engaging portion, provided at a leading end with respect to a direction from the receiving position to the mount position, configured and positioned to engage with the locking portion which is movable in interrelation with the movement of the movable guide, the engaging portion receiving a pulling force in the direction from the receiving position toward the mount position by movement of the locking portion in interrelation with the movement of the movable guide while being in engagement with the engaging portion, said process cartridge mounting mechanism comprising the movable guide, the locking portion, the first and second portions to be carried, the first and second positioning portions, and the engaging portion.

11. A process cartridge mounting mechanism according to claim 10, wherein said movable guide is swingably relative to said image forming apparatus in interrelation with an opening and closing operation of an openable member provided in said image forming apparatus.

12. A mechanism according to claim 10, wherein said engaging portion is disposed at a leading side of the cartridge frame with respect to a mounting direction in which the process cartridge is mounted to the main assembly of the electrophotographic image forming apparatus.

13. A mechanism according to claim 12, wherein said engaging portion is projected from the cartridge frame in the mounting direction, and is provided at each of lateral sides of the cartridge frame.

14. A mechanism according to claim 13, wherein said locking portion is slidable relative to said movable guide in interrelation with movement of the movable guide.

15. A mechanism according to claim 10 or 12, wherein said movable guide is swingable relative to the image forming apparatus in interrelation with an opening and closing operation of an openable member provided in the image forming apparatus.

16. A mechanism according to claim 15, wherein said locking portion has a stepped portion which provides portions remote from said engaging portion at different distances, wherein at the start of engagement with said engaging portion of the process cartridge, the pulling force is not applied, and the pulling force is supplied with swinging of said movable guide.

* * * * *

UNITED STATES PATENT AND TRADEMARK OFFICE

CERTIFICATE OF CORRECTION

PATENT NO. : 7,340,197 B2
APPLICATION NO. : 11/190022
DATED : March 4, 2008
INVENTOR(S) : Kazunari Murayama et al.

It is certified that error appears in the above-identified patent and that said Letters Patent is hereby corrected as shown below:

COLUMN 1
Line 21, “sheet.” should read --sheet,--.

COLUMN 2
Line 17, “above described” should read --above-described--.

COLUMN 5
Line 22, “feature” should read --feature.--.

COLUMN 7
Line 29, “roaching” should read --reaching--.

COLUMN 8
Line 51, “21Bk.” should read --21Bk,--.

COLUMN 11
Line 11, “above” should read --above- --.

COLUMN 13
Line 36, “assemble A,” should read --assembly A,--.
Line 44, “26.” should read --26--.

COLUMN 14
Line 4, “Similarly.” should read --Similarly,--.
Line 6, “26.” should read --26,--.
Line 13, “above” should read --above- --.

COLUMN 15
Line 12, “38a.” should read --38a,--.
Line 46, “ment.” should read --ment,--.

UNITED STATES PATENT AND TRADEMARK OFFICE

CERTIFICATE OF CORRECTION

PATENT NO. : 7,340,197 B2
APPLICATION NO. : 11/190022
DATED : March 4, 2008
INVENTOR(S) : Kazunari Murayama et al.

It is certified that error appears in the above-identified patent and that said Letters Patent is hereby corrected as shown below:

COLUMN 17
Line 56, “14;” should read --14--.

COLUMN 19
Line 21, “Positioning” should read --positioning--.
Line 49, “cart” should read --cart- --.

COLUMN 20
Line 36, “he” should read --be--.

COLUMN 21
Line 16, “above described” should read --above-described--.
Line 30, “the,” (first occurrence) should be deleted.

COLUMN 22
Line 28, “and no of” should read --of--.
Line 51, “pressed.” should read --pressed--.
Line 55, “above described” should read --above-described--.
Line 57, “he” should read --be--.

COLUMN 23
Line 46, “Lo” should read --to--.
Line 52, “Same direction.” should read --same direction,--.

COLUMN 24
Line 33, “above described” should read --above-described--.

COLUMN 25
Line 13, “arc” should read --are--.
Line 59, “amount,” should read --amount--.

UNITED STATES PATENT AND TRADEMARK OFFICE

CERTIFICATE OF CORRECTION

PATENT NO. : 7,340,197 B2
APPLICATION NO. : 11/190022
DATED : March 4, 2008
INVENTOR(S) : Kazunari Murayama et al.

It is certified that error appears in the above-identified patent and that said Letters Patent is hereby corrected as shown below:

COLUMN 26
Line 8, “portion 85.” should read --portion 85--.
Line 18, “catches,” should read --latches,--.

COLUMN 27
Line 16, “c:artridge” should read --cartridge--.

COLUMN 28
Line 41, “mounted” should read --mounts--.

Signed and Sealed this

Third Day of February, 2009

JOHN DOLL
*Acting Director of the United States Patent and Trademark Office*